US007278241B2

(12) United States Patent
Wirawan

(10) Patent No.: US 7,278,241 B2
(45) Date of Patent: Oct. 9, 2007

(54) WINDOW ASSEMBLY

(76) Inventor: Margaretha H. Wirawan, 401 Avenue D, Redondo Beach, CA (US) 90277

( * ) Notice: Subject to any disclaimer, the term of this patent is extended or adjusted under 35 U.S.C. 154(b) by 316 days.

(21) Appl. No.: 10/645,984

(22) Filed: Aug. 22, 2003

(65) Prior Publication Data

US 2005/0000174 A1 Jan. 6, 2005

Related U.S. Application Data

(60) Provisional application No. 60/484,486, filed on Jul. 2, 2003.

(51) Int. Cl.
*E04C 1/42* (2006.01)

(52) U.S. Cl. ..... 52/203; 52/204.6; 52/308; 52/786.1

(58) Field of Classification Search ..... 52/202, 52/203, 306–308, 204.6, 204.593, 204.59, 52/786.1, 786.13, 656.7; 49/61, 62
See application file for complete search history.

(56) References Cited

U.S. PATENT DOCUMENTS 2,079,283 A * 5/1937 Etling ..... 49/367
2,716,783 A * 9/1955 Fegan ..... 52/202
2,935,769 A * 5/1960 Lutes ..... 52/202
3,191,727 A * 6/1965 Schmeltz et al. ..... 52/204.593
3,451,681 A * 6/1969 Rossetti ..... 273/157 R
3,460,303 A * 8/1969 Algrain et al. ..... 52/314
3,668,808 A * 6/1972 Perina ..... 49/465
3,798,869 A * 3/1974 Nipp ..... 52/742.1
3,971,178 A * 7/1976 Mazzoni et al. ..... 52/172
4,068,428 A * 1/1978 Peterson, III ..... 52/202
4,069,641 A * 1/1978 DeZutter ..... 52/202
4,164,830 A * 8/1979 Bierlich ..... 52/204.593
4,194,331 A * 3/1980 Gingle et al. ..... 52/203
4,357,187 A * 11/1982 Stanley et al. ..... 156/107
4,409,758 A * 10/1983 Dickerson et al. ..... 49/463
4,441,290 A * 4/1984 Abell ..... 52/202
4,459,789 A * 7/1984 Ford ..... 52/656.5
4,561,223 A * 12/1985 Gold et al. ..... 52/202
4,581,865 A * 4/1986 Miller ..... 52/202
4,699,842 A * 10/1987 Jorgensen et al. ..... 428/343
4,733,510 A * 3/1988 Werner ..... 52/202
4,756,938 A * 7/1988 Hickman ..... 428/38
4,783,938 A 11/1988 Palmer
4,883,721 A 11/1989 Nalepka et al.

(Continued)

FOREIGN PATENT DOCUMENTS

DE 31 03 548 A1 * 8/1982

OTHER PUBLICATIONS

Product Information on "Windo-Therm Window Insulation System", www.windotherm.com, site visited Aug. 22, 2003.

(Continued)

*Primary Examiner*—Robert Canfield
(74) *Attorney, Agent, or Firm*—Knobbe, Martens, Olson & Bear LLP

(57) ABSTRACT

A window assembly comprises a window frame. A non-specular window panel assembly is supported by the window frame, and can comprise of a plurality of glass blocks joined together. A low-emissivity window panel assembly is juxtaposed to the non-specular window panel assembly. The window frame supports the low-emissivity window panel assembly.

9 Claims, 28 Drawing Sheets

U.S. PATENT DOCUMENTS

| | | | | | |
|---|---|---|---|---|---|
| 4,942,704 | A | * | 7/1990 | King | 52/171.3 |
| 5,079,886 | A | * | 1/1992 | Downs | 52/314 |
| 5,083,409 | A | * | 1/1992 | Pliml, Jr. | 52/656.9 |
| 5,339,588 | A | * | 8/1994 | Ballstadt | 52/308 |
| 5,352,532 | A | * | 10/1994 | Kline | 428/447 |
| 5,418,021 | A | | 5/1995 | Kim | |
| 5,448,864 | A | * | 9/1995 | Rosamond | 52/307 |
| 5,622,019 | A | * | 4/1997 | Dorough, Jr. | 52/308 |
| 5,687,521 | A | * | 11/1997 | Carlson et al. | 52/308 |
| 5,715,636 | A | * | 2/1998 | Taylor | 52/308 |
| 5,821,001 | A | * | 10/1998 | Arbab et al. | 428/623 |
| 5,899,027 | A | * | 5/1999 | St. Louis | 52/63 |
| 5,904,020 | A | * | 5/1999 | Carlson et al. | 52/308 |
| 5,937,595 | A | * | 8/1999 | Miller | 52/202 |
| 5,992,111 | A | | 11/1999 | Waterhouse | |
| 6,094,290 | A | | 7/2000 | Crawford et al. | |
| 6,240,685 | B1 | * | 6/2001 | Eichhorn | 52/204.61 |
| 6,493,128 | B1 | | 12/2002 | Agrawal et al. | |
| 6,553,733 | B1 | | 4/2003 | Hock et al. | |
| 6,640,510 | B2 | * | 11/2003 | Kane | 52/204.59 |
| 6,735,922 | B2 | * | 5/2004 | Paffen | 52/786.1 |
| 6,974,518 | B2 | * | 12/2005 | Hornung et al. | 156/109 |
| 7,043,885 | B2 | * | 5/2006 | LeMert | 52/308 |
| 7,114,299 | B2 | * | 10/2006 | Ringness | 52/204.1 |
| 2003/0005655 | A1 | | 1/2003 | LeMert | |

OTHER PUBLICATIONS

International Search Report dated Feb. 1, 2006 for PCT Application No. PCT/US04/27276, Applicant: Margaretha H. Wirawan.

* cited by examiner

WINDOW ASSEMBLY

RELATED APPLICATIONS

This application is based upon and claims the priority of U.S. Provisional Patent Application No. 60/484,486, filed on Jul. 2, 2003, which is hereby incorporated by reference in its entirety.

BACKGROUND OF THE INVENTION

1. Field of the Invention

The present application is directed to a window assembly, and more particularly to a window assembly with a plurality of window panels.

2. Description of the Related Art

Glass has many qualities that make it well suited for use in windows, including transparency or translucency, hardness, imperviousness to the natural elements, insulating properties, and an ability to be formed into various shapes. Windows, walls, and other partitions have long been formed from glass blocks that admit the passage of light but, because of their thickness and non-specular surface, do not permit a clear view of objects beyond the glass.

Glass block is ideal for any situation or setting where both natural illumination and privacy are desired. However, increased awareness of energy conservation has caused many governments to increase the energy efficiency requirements of windows. Concerns regarding thermal efficiency of glass block windows have limited the wide incorporation of glass block windows into exterior walls.

SUMMARY OF THE INVENTION

An aspect of at least one of the inventions disclosed herein includes the realization that low-emissivity glass panels, or low-E glass panels, can be used in conjunction with other types of glass assemblies which heretofore have not been widely available with low-E properties. For example, but without limitation, glass block is non-specular. Application of low-E coatings directly to glass blocks is unsatisfactory due to the non-specular surfaces of glass blocks, which can generate color-splotching, among other optical and/or aesthetic abnormalities, that can be incongruent with the desired optical and/or aesthetic effects of some window assemblies. Accordingly, an improved window assembly is desired that combines the aesthetic and functional features of window assemblies that are not currently available with low-emissivity properties, with the properties of low-emissivity panels.

In accordance with another aspect of at least one of the inventions disclosed herein, a window assembly comprises a window frame. A plurality of glass blocks form a glass block window supported by the frame. A transparent low-emissivity panel is juxtaposed to the plurality of glass blocks and supported by the frame.

In accordance with yet another aspect of at least one of the inventions disclosed herein, a window assembly comprises a first window frame. A first window panel assembly is supported by the frame. The frame defines an accessory pocket extending around the periphery thereof. A second window frame engages with the accessory pocket.

In accordance with a further aspect of at least one of the inventions disclosed herein, a window assembly comprises a frame. A first window panel assembly is supported by the frame and has a first visual appearance. A second window panel assembly is supported by the frame and has a second visual appearance different from the first visual appearance.

In accordance with an additional aspect of at least one of the inventions disclosed herein, a window assembly comprises a window frame. A glass block window panel is supported by the window frame and comprises a plurality of non-specular glass blocks joined together. A low-emissivity window panel assembly is juxtaposed to the glass block window panel on an outer side of the glass block window panel. The low-emissivity window panel assembly is supported by the window frame.

BRIEF DESCRIPTION OF THE DRAWINGS

These and other features and advantages of the inventions will become more apparent upon reading the following detailed description and with reference to the accompanying drawings of embodiments that exemplify the inventions, in which.

DETAILED DESCRIPTION OF THE PREFERRED EMBODIMENTS

Figure 1:
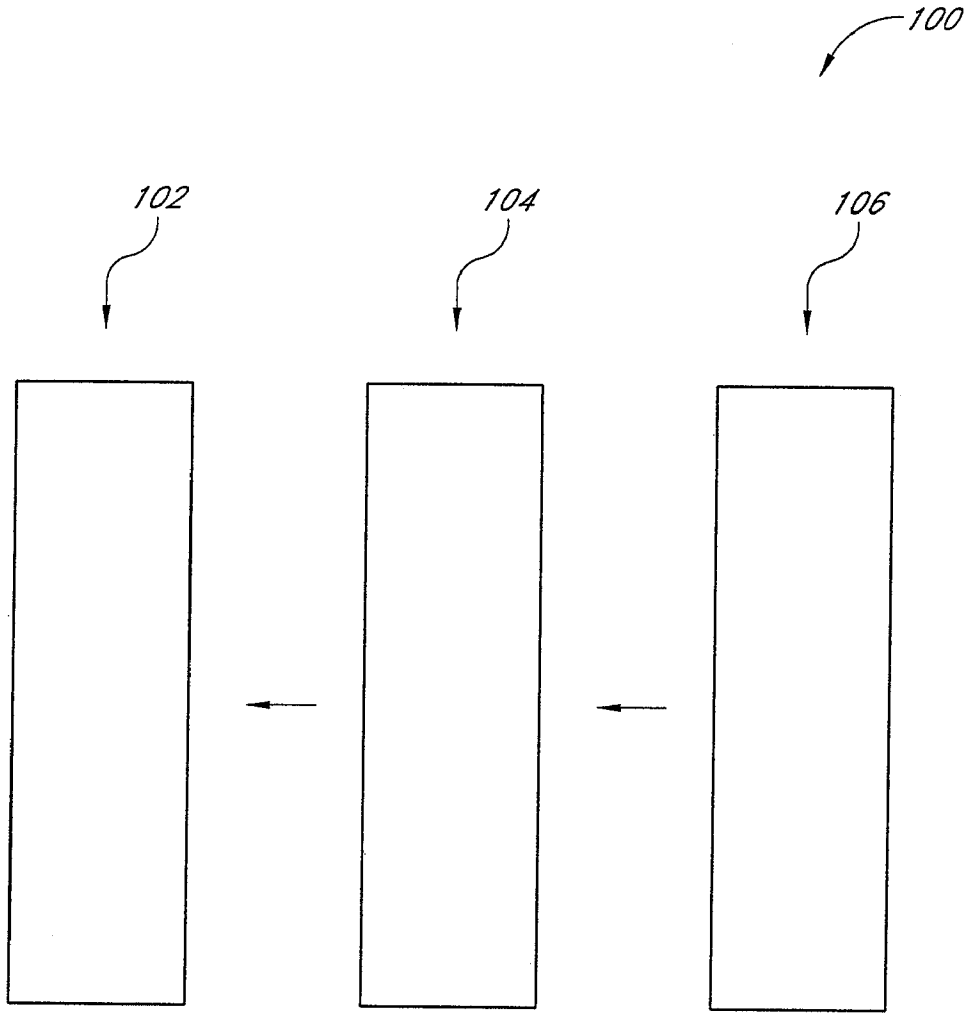
FIG. 1 is a schematic view of a window assembly according to one embodiment.

With reference to FIG. 1, a window assembly 100 having certain features, aspects and advantages of the present inventions is described below. The window assembly 100 is one environment for which many features, aspects and advantages of the present inventions have been specially adapted. Nevertheless, certain features, aspects and advantages of the present inventions can be used with other similar structures.

The window assembly 100 preferably comprises a frame 102, a first window panel assembly 104, and a second window panel assembly 106. The frame 102, the first window panel assembly 104, and the second window panel assembly 106 can be configured to be coupled together to form a sealed unit. In some embodiments, described further below, the window assembly 100 comprises a plurality of window panel assemblies.

The first window panel assembly 104 can comprise a panel that has a certain desired aesthetic or functional quality. The second window panel assembly 106 can also comprise a panel that has a certain desired aesthetic or functional quality. The first and second window panel assemblies 104, 106 preferably comprise different aesthetic or functional qualities. However, in some embodiments having more than two window panel assemblies, the first and second window panel assemblies 104, 106 can have the same or similar aesthetic or functional features. For example, in embodiments having three window panel assemblies, two of the three can have the same or similar features, or all three window panel assemblies can have different aesthetic or functional qualities and features.

Window panel assemblies can comprise, for example, without limitation, glass block window panels, low-E glass panels, insulated glass panels, solar reflective panels, low glare panels, photochromatic panels, fire-rated panels, blast-resistant panels, hurricane-resistant panels, self cleaning glass, one-way mirrors, tinted glass, safety glass, tempered glass, plain glass, low-E films, blast-resistant films, hurricane resistant films, tint films, solar reflective films, fresnel screens, translucent art, stained glass, textured glass, antique glazing, historical glazing, translucent LCD screens, previously installed glazing, fragile glazing, liquids, lighting elements, heating elements, vacuum chambers, air chambers, gas chambers, and desiccant members. These are merely examples of some window members that can be used. The scope of the application is not limited to embodiments having these specific members. Any other window members can also be used.

As mentioned previously, at least two of the window panel assemblies have differing functional or aesthetic features. For example, the first window panel assembly 104 can comprise a non-specular panel, such as, for example, but without limitation, a glass block window. As such, a further advantage is provided where the second window panel assembly 106 comprises a low-emissivity glass panel. As such, the assembly 100 can be used in many applications which heretofore have not been practicable. For example, materials with non-specular surfaces, such as glass block, present barriers to incorporation into exterior windows, doors and walls. The wide availability of what is commonly referred to as low-emissivity or "low-E" glass, has caused many governments to raise insulation requirements. As such, it has recently become more difficult to incorporate non low-E glass components, such as, for example, but without limitation, glass block, on building exteriors.

Thus, by utilizing a low-E glass panel as the second assembly 106, the assembly 100 can provide the desired aesthetic effect of the first assembly 104 and the energy-saving effect of a low-e material. As such, the assembly 100 can be used in a greater proportion on a building and remain in compliance with the recently enhanced insulation requirements in many countries.

Figure 2A:
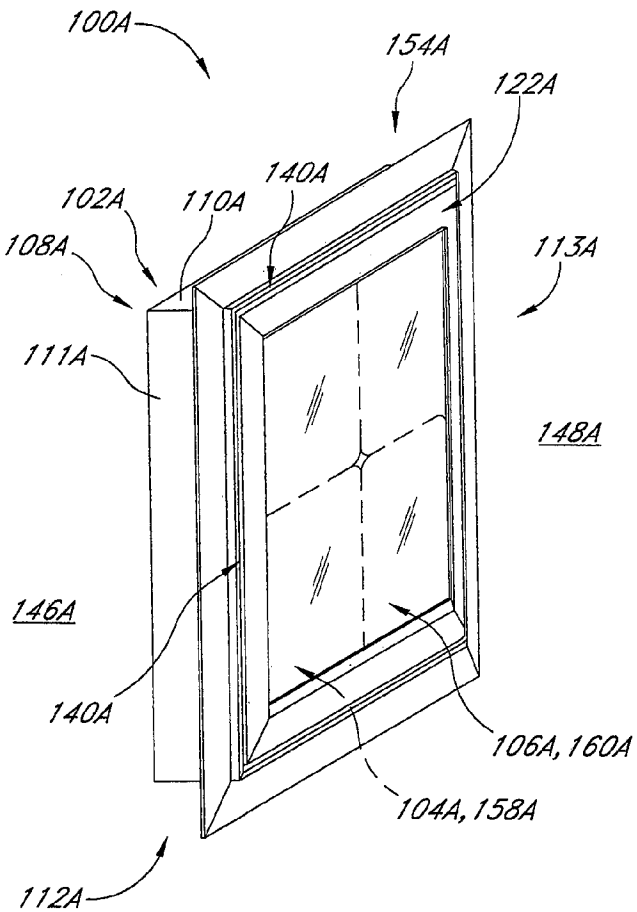
FIG. 2A is a schematic perspective view of the window assembly shown in FIG. 2.
Figure 2:
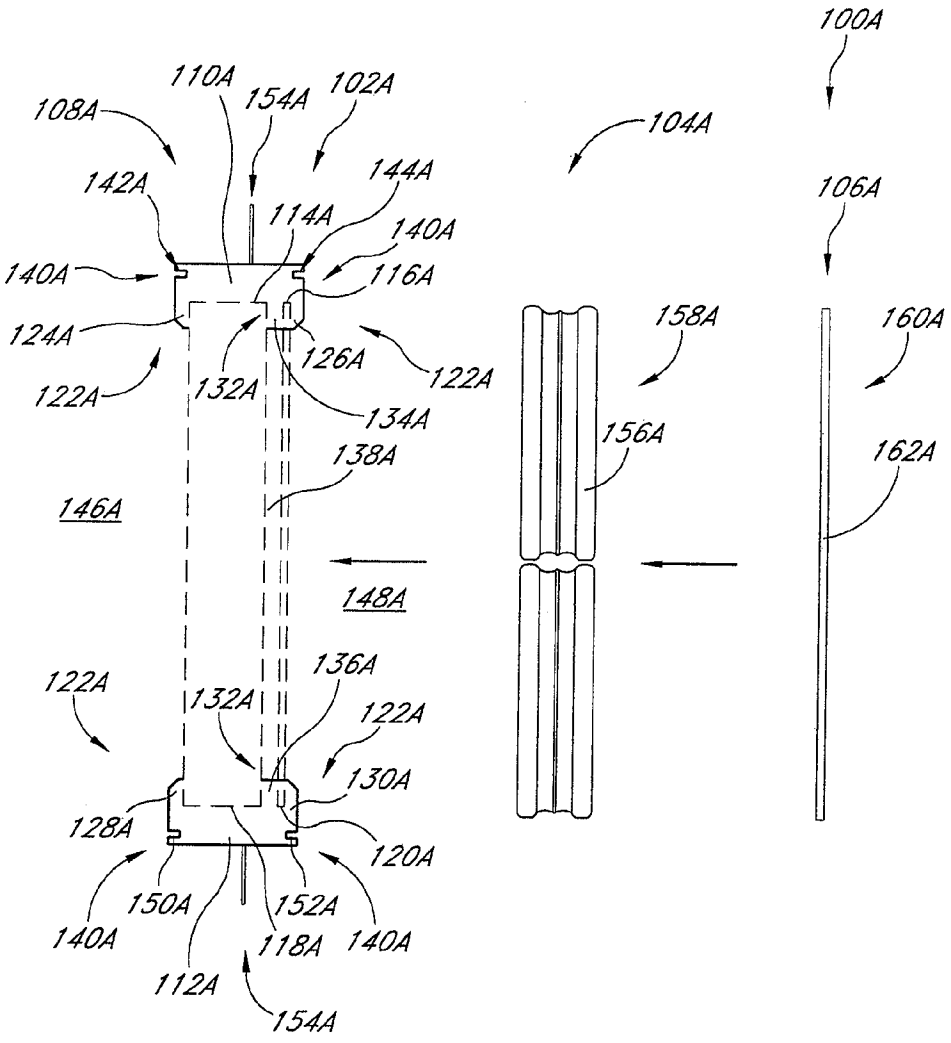
FIG. 2 is an exploded side elevational view of another embodiment of the window assembly shown in FIG. 1.

FIGS. 2 and 2A show an exemplary embodiment of the window assembly 100, identified generally by the reference numeral 100A. Components of the window assembly 100A that correspond to components of window assembly 100 have been given the same reference numeral, except that a letter "A" has been added thereto.

The window assembly 100A preferably comprises a frame 102A, a first window panel assembly 104A, and a second window panel assembly 106A. Preferably, the frame 102A, the first window panel assembly 104A, and the second window panel assembly 106A can be configured to be coupled to form the window assembly 100A.

As shown in FIG. 2, the frame 102A is in the form of a window frame 108A. The window frame 108A preferably has an upper portion 110A and a lower portion 112A. The window frame 108A can have side portions 111A, 113A, as shown in FIG. 2A. As used herein, the terms "upper", "lower" and "side" correspond to a position when the window assembly 100A is in an upright configuration, such as when such a window assembly is installed in a wall. However, these terms are not intended to indicate a required orientation. Rather, these terms are used merely to provide relative position information in one preferred environment of use.

In the illustrated embodiment, the window frame 108A can have a plurality of window panel support portions 114A, 116A, 118A, 120A. The side portions 111A, 113A, also include panel support portions (not shown) having a similar construction.

The upper portion 110A preferably defines the first window panel support portion 114A and the second window panel support portion 116A. The lower portion 112A preferably defines the first window panel support portion 118A and the second window panel support portion 120A.

The first window panel support portions 114A, 118A of the upper portion 110A and lower portion 112A preferably cooperate to support the first window panel assembly 104A. The second window panel support portions 116A, 120A of the upper portion 110A and lower portion 112A preferably cooperate to support the second window panel assembly 106A. The corresponding support portions of the side portions 111A, 113A support the panels 104A, 106A in a similar manner.

The support portions 114A, 116A, 118A, 120A, and the corresponding support portions of the side portions 111A, 113A, can be in the form of open channels defined in the respective portions of the window frame 108A. The channels can be sized to form a close fit with the corresponding peripheries of the panels 104A, 106A.

The window frame 108A preferably has at least one glazing bead assembly 122A configured to secure the first window panel assembly 104A and the second window panel assembly 106A within the window frame 108A. In the illustrated embodiment, the glazing bead assemblies 122A are fixed to the window frame 108A. In other embodiments, the glazing bead assemblies 122A can be operable or removable. One or more operable or removable glazing bead assemblies 122A can provide access to the first or second window panel assembly 104A, 106A. Alternatively, some of the glazing bead assemblies 122A can be fixed and others can be operable or removable.

As shown in FIG. 2, the glazing bead assemblies 122A preferably are coupled with the window frame 108A adjacent first and second window panel support portions 114A, 116A, 118A, 120A. In the illustrated embodiment, the upper portion 110A has a first glazing bead 124A and a second glazing bead 126A. Additionally, the lower portion 112A has a first glazing bead 128A and a second glazing bead 130A.

The window frame 108A can also include one or more spacers 132A between the first window panel assembly 104A and the second window panel assembly 106A. In some embodiments, the window frame 108A can have a spacer around the periphery of the window frame 108A. In the illustrated embodiment the frame 108A includes an upper spacer 134A and a lower spacer 136A, and left and right spacers (not shown). Additionally, in the illustrated embodiment, the spacers 132A are fixed to the window frame 108A. Alternatively, the spacers 132A can be operable or removable. In some embodiments, the spacers 132A can be additional glazing bead assemblies 122A. Optionally, the spacers 132A can comprise a desiccant material. As is known in the art, a desiccant material can be disposed between window panels to actively absorb moisture and thereby reduce the possibility that condensation can form between two panels.

In some embodiments, the first window panel assembly 104A, the second window panel assembly 106A, and the window frame 108A define a space 138A. The space 138A can provide an insulating function or provide a functionally usable space. For example, the space 138A can be filled with air. The space 138A can also be filled with a gas, such as, for example, argon or krypton to enhance the insulative effect. In some embodiments, the space 138A can contain a vacuum, a liquid, a powder, a film, aesthetic components, or structural components, such as, for example, electrical components for heating or lighting.

With reference to FIG. 2, the window frame 108A can also include an accessory pocket 140A which extends around the periphery of the window frame 108A.

As shown in FIG. 2, accessory pockets 142A, 144A are defined in the upper portion 110A of the window frame 108A on an interior side 146A and on an exterior side 148A. Accessory pockets 150A, 152A are also defined in the lower portion 112A of the window frame 108A on an interior side 146A and on an exterior side 148A. Accessory pockets 140A can also be disposed in the side portions 111A, 113A of the window frame 108A on an interior side 146A and on an exterior side 148A. The terms "interior" and "exterior" are used to simplify the description of illustrated embodiments but do not limit embodiments to particular configurations. The accessory pocket 140A can be configured to cooperate with an accessory (not shown) so as to couple the accessory with the window frame 108A. For example, flashing trim, stucco-guide, or siding return is sometimes connected to conventional accessory pockets, to finish off the exterior gap where the window frame 108A meets exterior finish of the building.

In the illustrated embodiment, the window frame 108A includes a flange 154A. Alternatively, in other embodiments, the window frame 108A preferably does not have a flange 154A.

The flange 154A preferably extends around the periphery of the window frame 108A. As shown in FIG. 2, the flange 154A extends from the upper portion 110A of the window frame 108A and from the lower portion 112A of the window frame 108A. As shown in FIG. 2A, the flange 154A also extends from the side portions 111A, 113A of the window frame 108A. The flange 154A preferably facilitates securing the window frame 108A to a structure supporting the window frame 108A. For example, the flange 154A can be in the form of a "nailing flange," the construction of which is well-known in the art. Additionally, the flange 154A preferably acts to prevent water or air infiltration.

The window frame 108A can also include a weep system (not shown). Such a weep system can be configured to prevent moisture from accumulating around the window frame 108A for prolonged periods of time. For example, the weep system can comprise holes or slots that normally will allow unwanted moisture to drain away to an exterior location by gravity.

With continued reference to FIG. 2, the first window panel assembly 104A can comprise a non-specular, translucent, or transparent panel. In the illustrated embodiment, the first window panel assembly 104A comprises a plurality of glass blocks 156A forming a glass block window 158A. The first window panel assembly 104A can also comprise other structures as described herein.

The glass block window 158A preferably comprises one or more glass blocks 156A. Glass blocks 156A preferably comprise a glazing material. A glazing material can be a glass, or glasslike, material fit, furnished, or secured in a structure.

As used herein, the term "non-specular" refers to material with a surface that is generally less smooth and/or generally less reflective than a specular material. Non-specular glazing preferably comprises glazing material having one or more surfaces that can be uneven, rough, irregular, unfinished, imperfect, wavy, contoured, etched, patterned, scored, or otherwise less smooth than a specular glazing surface. Additionally, non-specular glazing can comprise glazing material having one or more surfaces that can appear cloudy, diffuse, translucent, or less reflective than a specular glazing surface. Such materials are widely used for windows, doors or walls where it is desired to allow light to pass therethrough while preventing clear visibility.

Materials with such non-specular surfaces present barriers to incorporation into exterior windows, doors and walls. For example, the wide availability of what is commonly referred to as low-E glass, has caused many governments to raise insulation requirements. As such, it has recently become more difficult to incorporate non low-E glass components on building exteriors and remain in compliance with such insulation requirements.

Non-specular glass surfaces suffer from several drawbacks when low-E coatings are applied thereto. For example, attempts to apply certain low-E coatings, such as those containing oxides, in an even and consistent thickness over a non-specular glass surface results in areas of varying light diffraction, thereby creating rainbow-like color smears when struck with light. In the case of glass blocks, additional drawbacks includes cost inefficiency of applying low-E coating on such a relatively small glazing surface individually, block by block. As such, non-specular materials with low-E coatings are not generally available, nor are they found to be satisfactory from an aesthetic point of view.

The glass blocks 156A can have a typical non-specular surface. The glass blocks 156A preferably form a glass block window 158A that is at least translucent. In some embodiments, glass blocks 156A preferably comprise blocks 156A made of glass or acrylic. Other suitable block materials, which is apparent to those skilled in the art, can be used in other embodiments. Combinations of blocks 156A of similar or different sizes, shapes, patterns, design, colors and materials can also be used.

The glass blocks 156A can be arranged in a pre-assembled fillet of blocks. For example, a plurality of glass blocks can be bonded or mechanically connected to form a panel in which outer surfaces of the glass blocks are aligned generally in a plane or along a curved surface. For example, the glass blocks 156A can be arranged in a panel or grid using mortar or caulking. In some embodiments, a panel or grid can comprise a support member, or spacer, made of wood, metal, plastic or other material. A panel or grid can comprise a trough or groove between blocks for receiving caulking or mortar.

In the illustrated embodiment, the glass block window 158A can be supported in the window frame 108A at the first window panel support portions 114A, 118A. The glass block window 158A can be secured within the window frame 108A by glazing beads 124A, 128A and spacers 134A, 136A.

With continued reference to FIG. 2, the second window panel assembly 106A can be a low-emissivity panel 160A. In some embodiments, the second window panel assembly 106A can be a single glazing member 162A. In other embodiments, the second window panel assembly 106A can be an insulating glass unit, or IG unit (not shown). IG units preferably have a plurality of panes or glazing members. The second window panel assembly 106A can also comprise other structures, including structures described herein.

A further advantage is provided where the low-emissivity panel 160A is transparent. As such, the panel 160A allows the glass block panel 158A to be viewed without substantial visual impedance, thus providing the appearance of a glass block window. The low-emissivity panel 160A can have a specular glazing surface. The window frame 108A preferably supports the low-emissivity panel 160A. The low-emissivity panel 160A can be juxtaposed to the glass block window 158A.

The low-emissivity panel 160A preferably comprises a low-emissivity glass or film. Various kinds of low-E glass are commercially available. For example, some low-E glass comprises a thin, clear coating of a metal oxide. The coating allows most of the visible light to pass through, but is a barrier to longer infrared and near-infrared wavelengths. As such, low-E glass provides improved thermal performance and reduces solar heat gain in residential and commercial glazing applications compared to standard uncoated glass units.

Low-E glass is also commercially available in hard coat or soft coat. Hard coat low-E, or pyrolytic coating, is a coating that can be applied at high temperatures and is sprayed onto the glass surface during the "float glass" process. Hard coat low-E generally is relatively durable and allows for ease of handling and tempering. Hard coat low-E can be tempered before or after the coating applications. Hard coat low-E can be used in single, or multiple, glazing applications. Hard coat low-E utilizes passive solar heat gain. Hard coat low-E products can include higher U values, slightly higher haze levels, and higher solar heat gain coefficient compared to soft coat low-E products.

Soft coat low-E, or sputter coating, is typically applied in multiple layers of optically transparent silver sandwiched between layers of metal oxide in a vacuum chamber. This process generally provides a high level of performance and a nearly invisible coating. Soft coat low-E can have high visible light transmission and ultra low emissivities giving optimum winter UV values. Soft coat low-E glass can have significantly less UV transmission compared with standard clear glazing, and optical clarity with minimal color haze. Soft coat low-E products are typically used in double glazed units because the soft coating is sensitive to handling. In soft coat low-E products, the glass preferably is tempered prior to the coating application. Edge deletion of the coating typically ensures a proper seal in an insulated unit.

A low-E film assembly can be used in place of, or in conjunction with, low E glass. In an exemplary low-E film assembly, a low-emissivity coated film can be suspended inside an insulating glass unit. The low-E film assembly preferably acts as a triple insulating glass unit, having an airspace on either side of the film. The low-E film assembly generally is much lighter than a triple insulating glass unit. The low-E film product can have superior insulating and shading performance compared with a triple insulating glass unit.

With continued reference to FIG. 2, the low-emissivity panel 160A can comprise a single pane 162A of hard coat low-E glass. In other embodiments, the low-emissivity panel 160A can comprise a plurality of panes or glazing members. Further, the low-emissivity panel 160A can comprise one or more of a hard coat low-E glass, a soft coat low-E glass, and a low-E film assembly.

As shown in FIG. 2, the low-emissivity panel 160A can be situated in the window frame 108A on the exterior side 148A and the glass block window 158A can be situated in the window frame 108A on the interior side 146A. This provides a further advantage in that there is an unobstructed view of the glass block window 158A from the interior of a building and there is a thermally protective low-E panel on the exterior of the building.

In the illustrated embodiment, the low-emissivity panel 160A can be supported in the window frame 108A at the second window panel support portions 116A, 120A. The low-emissivity panel 160A can be secured within the window frame 108A by glazing beads 126A, 130A and spacers 134A, 136A. The window assembly 100A illustrated in FIG. 2 preferably provides an insulated interior 146A and an aesthetically pleasing glass block window 158A.

The portions 110A, 11A, 112A, 113A of the window frame 108A can be formed from any material. Conventional manufacturing techniques can be used to form the portions 110A, 111A, 112A, 113A. For example, the portions 110A, 111A, 112A, 113A can be formed from an extruded plastic, Plyvinyl chloride (PVC Vinyl), pultruded fiberglass, thermally-broken aluminum, or other materials apparent to those skilled in the art. Alternatively, the frame 102A can be formed on site, as an integral portion of a wall, examples of which are described below with reference to FIGS. 18-21.

Figure 3:
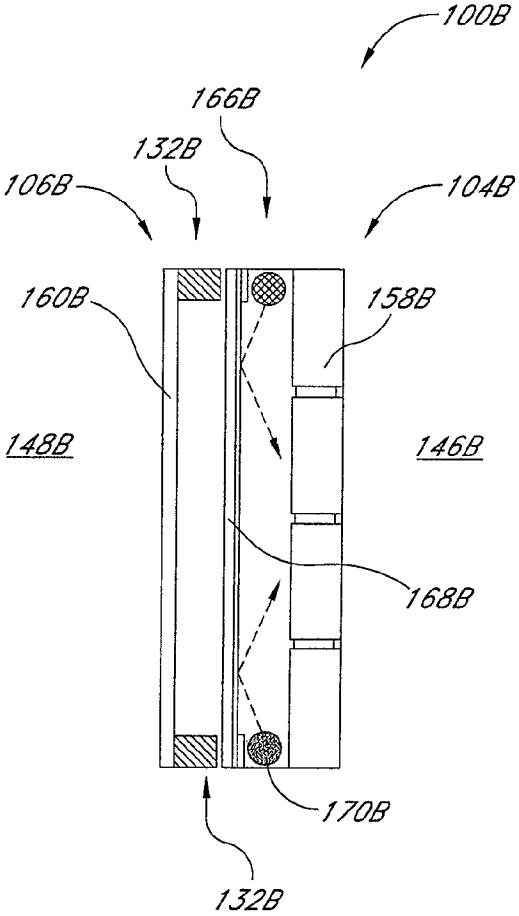
FIG. 3 is a schematic side elevational and partial sectional view of a modification of the window assembly shown in FIG. 2.

FIG. 3 illustrates a modification of the assembly 100A illustrated in FIG. 2, identified generally by the reference numeral 100B. Components of the window assembly 100B that correspond to components of window assembly 100A have been given the same reference numeral, except that a letter "B" has been added thereto.

In the embodiment illustrated in FIG. 3, the window assembly 100B comprises a first window panel assembly 104B, a second window panel assembly 106B and a third window panel assembly 166B. The first window panel assembly 104B preferably comprises a glass block window 158B. An outer surface of the glass block window 158B can face toward an interior location 146B.

The second window panel assembly 106B preferably comprises a low-emissivity panel 160B. An outer surface of the low-emissivity panel 160B can face toward an exterior location 148B.

The third window panel assembly 166B preferably comprises an aesthetically pleasing element, system, or combination, such as, for example, a one way mirror 168B, or a reflector 168B, and a light 170B, such as, for example, a rope light. The third window panel assembly 166B can be disposed between the first and second window panel assemblies 104B, 106B.

One or more spacers 132B preferably are disposed between the second window panel assembly 106B and the third window panel assembly 166B. The window panel 100B can include a frame (not shown) configured to support the assemblies 104B, 106B, and 166B. The disclosure set forth above with respect to the frame 108A is sufficient to enable one of ordinary skill in the art to make and use a frame for the assembly 100B. Thus, further descriptions of window frames are not repeated with respect to the embodiments of FIGS. 3-17. As shown in FIG. 3, the window panel 100B preferably provides an insulated interior and a novel back-lighted glass block window 158B.

Figure 4:
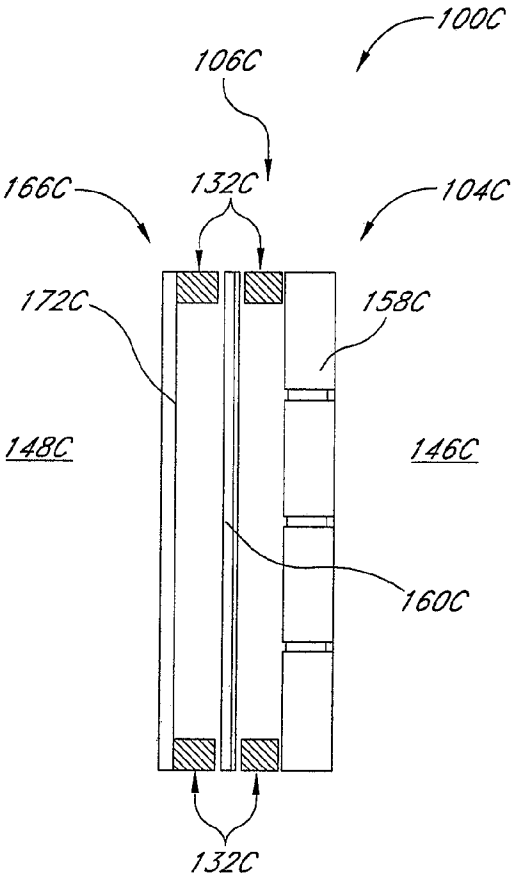
FIG. 4 is a schematic side elevational and partial sectional view of a modification of the window assembly shown in FIG. 2.

FIG. 4 illustrates a modification of the assembly 100A illustrated in FIG. 2, identified generally by the reference numeral 100C. Components of the window assembly 100C that correspond to components of window assembly 100A have been given the same reference numeral, except that a letter "C" has been added thereto.

In the embodiment illustrated in FIG. 4, the window assembly 100C preferably comprises a first window panel assembly 104C, a second window panel assembly 106C and a third window panel assembly 166C. The first window panel assembly 104C preferably comprises a glass block window 158C. The glass block window 158C can face an interior location 146C.

The second window panel assembly 106C preferably comprises a low-emissivity panel 160C. The low-emissivity panel 160C can be disposed between the first and third window panel assemblies 104C, 166C.

The third window panel assembly 166C preferably comprises a protective member 172C, such as, for example, fire-rated glass. One or more spacers 132 can be disposed between the first window panel assembly 104C and the second window panel assembly 106C, and between the second window panel assembly 106C and the third window panel assembly 166C.

The third window panel assembly 166C preferably faces an exterior location 148C. Alternatively, the third window panel assembly 166C can face an interior location. As such, the third window panel assembly 166C can operate to prevent a fire from breaking through the window panel 100C, in accordance with certain zero-lot line building codes. Optionally, the glass block window 158C can be disposed between the low-emissivity panel 160C and the third window panel assembly 166C. As such, the window 100C benefits from the positioning of the low-e panel on an exterior side and from the protection, such as fire protection, provided by the third assembly 166C on the interior side. Additionally, in this arrangement, the glass block window 158C can be completely encased within the window 100C, thereby reducing or eliminating any maintenance for or cleaning of the glass block window 158C.

Figure 5:
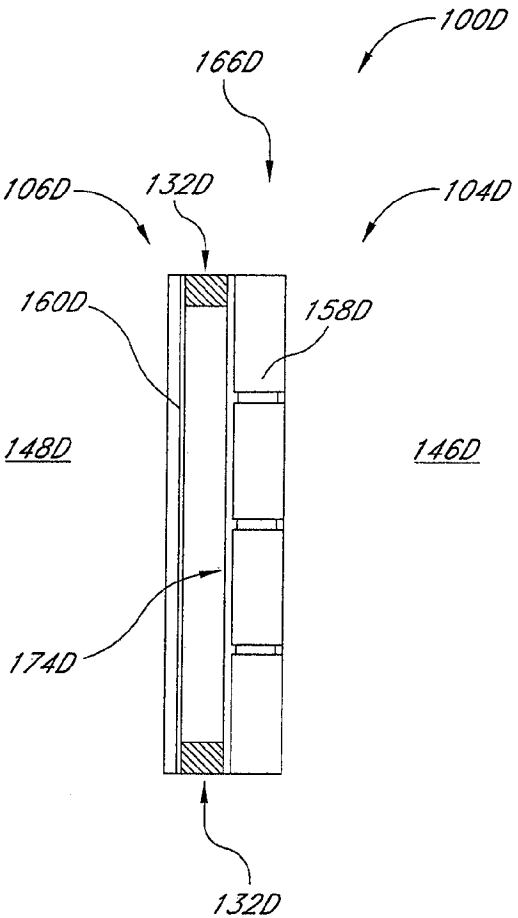
FIG. 5 is a schematic side elevational and partial sectional view of a modification of the window assembly shown in FIG. 2.

FIG. 5 illustrates another modification of the assembly 100A illustrated in FIG. 2, identified generally by the reference numeral 100D. Components of the window assembly 100D that correspond to components of window assembly 100A have been given the same reference numeral, except that a letter "D" has been added thereto.

In the embodiment illustrated in FIG. 5, the window assembly 100D preferably comprises a first window panel assembly 104D, a second window panel assembly 106D and a third window panel assembly 166D. The first window panel assembly 104D preferably comprises a glass block window 158D. The glass block window 158D can face an interior location 146D.

The second window panel assembly 106D preferably comprises a low-emissivity panel 160D. The low-emissivity panel 160D can face an exterior location 148D.

The third window panel assembly 166D preferably comprises a protective film 174D, such as, for example, a hurricane-resistant film. The third window panel assembly 166D can be disposed between the first and second window panel assemblies 104D, 106D.

One or more spacers 132D can be disposed between the second window panel assembly 106D and the third window panel assembly 166D. As such, the window panel 100D can more easily satisfy strict building and energy codes in effect in certain areas having extreme climates.

Figure 6:
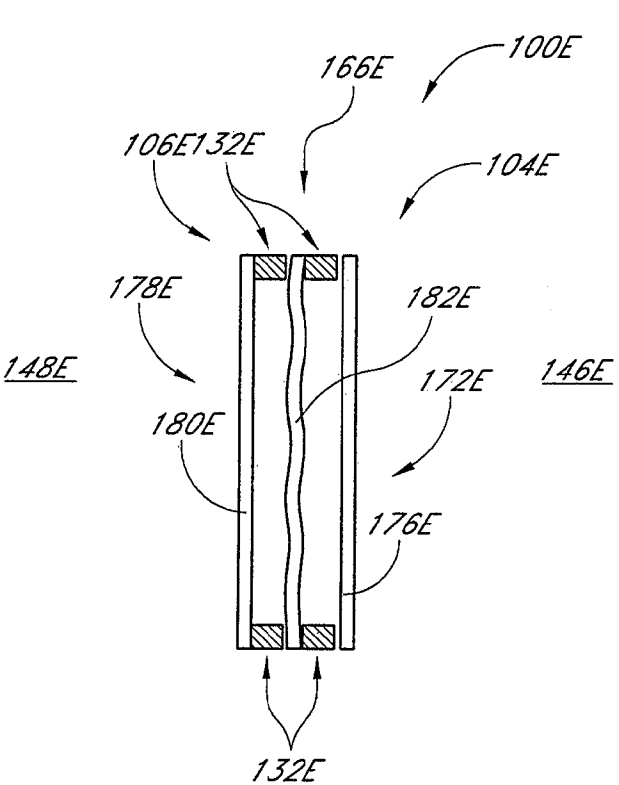
FIG. 6 is a schematic side elevational and partial sectional view of a modification of the window assembly shown in FIG. 2.

FIG. 6 illustrates a modification of the assembly 100A illustrated in FIG. 2, identified generally by the reference numeral 100E. Components of the window assembly 100E that correspond to components of window assembly 100A have been given the same reference numeral, except that a letter "E" has been added thereto.

In the embodiment illustrated in FIG. 6, the window assembly 100E preferably comprises a first window panel assembly 104E, a second window panel assembly 106E and a third window panel assembly 166E. The first window panel assembly 104E preferably comprises a first protective member 172E, such as, for example, safety glass 176E. The first protective member 172E can have a low-glare glazing member. The first protective member 172E can face an interior location 146E.

The second window panel assembly 106E preferably comprises a second protective member 178E, such as, for example, hurricane-resistant glass 180E. The second protective member 178E can have a low-glare glazing member. The second protective member 178E can face an exterior location 148E.

The third window panel assembly 166E can comprises a delicate member 182E, such as, for example, antique or fragile glass as in a historical building. The third window panel assembly 166E can be disposed between the first and second window panel assemblies 104E, 106E.

One or more spacers 132E can be disposed between the first window panel assembly 104E and the third window panel assembly 166E, and between the second window panel assembly 106E and the third window panel assembly 166E. As shown in FIG. 6, the window panel 100E surrounds and thus protects irreplaceable glazing, or other delicate members 182E, especially in a public locations, such as, for example, a museum.

Figure 7:
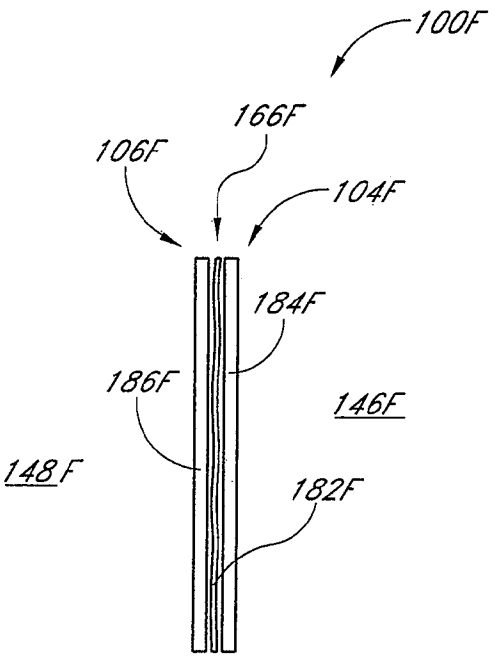
FIG. 7 is a schematic side elevational view of a modification of the window assembly shown in FIG. 2.

FIG. 7 illustrates a modification of the assembly 100A illustrated in FIG. 2, identified generally by the reference numeral 100F. Components of the window assembly 100F that correspond to components of window assembly 100A have been given the same reference numeral, except that a letter "F" has been added thereto.

In the embodiment illustrated in FIG. 7, the window assembly 100F preferably comprises a first window panel assembly 104F, a second window panel assembly 106F and a third window panel assembly 166F. The first window panel assembly 104F can comprise a regular glass window 184F. The regular window 184F can face an interior location 146.

The second window panel assembly 106F can also comprise a regular piece of glass 186F, or a low-emissivity panel. The regular piece of glass 186F can face an exterior location 148F.

The third window panel assembly 166F preferably comprises a delicate member 182F, such as, for example, cling film type translucent-art, similar in appearance to stained glass. The third window panel assembly 166F can be disposed between the first and second window panel assemblies 104F, 106F. As shown in FIG. 7, the window panel 100F surrounds and thus protects the delicate member 182F, thereby increasing the product-life of the normally fragile translucent art, and additionally provides an insulated interior, allowing for much larger translucent-art fenestration.

Figure 8:
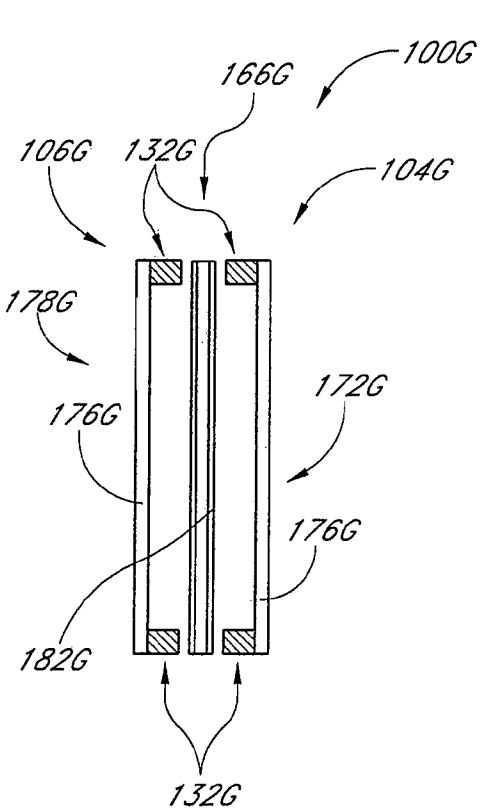
FIG. 8 is a schematic side elevational and partial sectional view of a modification of the window assembly shown in FIG. 2.

FIG. 8 illustrates a modification of the assembly 100A illustrated in FIG. 2, identified generally by the reference numeral 100G. Components of the window assembly 100G that correspond to components of window assembly 100A have been given the same reference numeral, except that a letter "G" has been added thereto.

In the embodiment illustrated in FIG. 8, the window assembly 100G preferably comprises a first window panel assembly 104G, a second window panel assembly 106G and a third window panel assembly 166G. The first window panel assembly 104G preferably comprises a first protective member 172G, such as, for example, safety glass 176G. The second window panel assembly 106G comprises a second protective member 178G, which can also be formed of safety glass 176G.

The third window panel assembly 166G preferably comprises a delicate member 182G, such as, for example, an expensive translucent liquid crystal display screen or other similar members. The third window panel assembly 166G can be disposed between the first and second window panel assemblies 104G, 106G.

One or more spacers 132G can be disposed between the first window panel assembly 104G and the third window panel assembly 166G, and between the second window panel assembly 106G and the third window panel assembly 166G. As shown in FIG. 8, the window panel 100G preferably acts to surround and thus protect the valuable and fragile member 182G.

Figure 9:
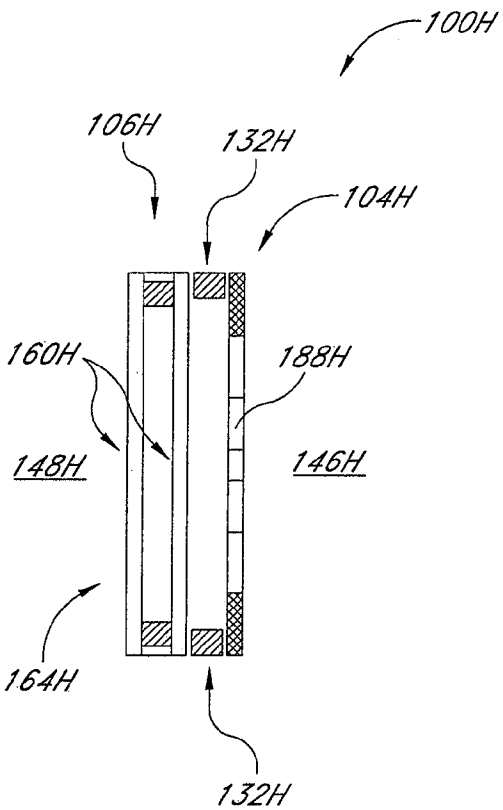
FIG. 9 is a schematic side elevational and partial sectional view of a modification of the window assembly shown in FIG. 2.

FIG. 9 illustrates yet another modification of the assembly 100A illustrated in FIG. 2, identified generally by the reference numeral 100H. Components of the window assembly 100H that correspond to components of window assembly 100A have been given the same reference numeral, except that a letter "H" has been added thereto.

In the embodiment illustrated in FIG. 9, the window assembly 100H comprises a first window panel assembly 104H and a second window panel assembly 106H. The first window panel assembly 104H can comprises a stained glass window 188H. The stained glass window 188H can face an interior location 146H.

The second window panel assembly 106H preferably comprises an insulating glass unit 164H. The insulating glass unit 164H can provide thermal insulation. Optionally, the insulating glass unit 164H can provide sound insulation. The insulating glass unit 164H can comprise one or more low-emissivity panels 160H. The insulating glass unit 164H can face an exterior location 148.

One or more spacers 132H can be disposed between the first window panel assembly 104H and the second window panel assembly 106H. The spacers 132H can comprise a desiccant. As shown in FIG. 9, the window panel 100H preferably provides for quiet, insulated, comfortable, or aesthetically pleasing surroundings, suitable for example, in a cathedral with extensive stained glass windows located in a noisy, bustling downtown area.

Figure 10:
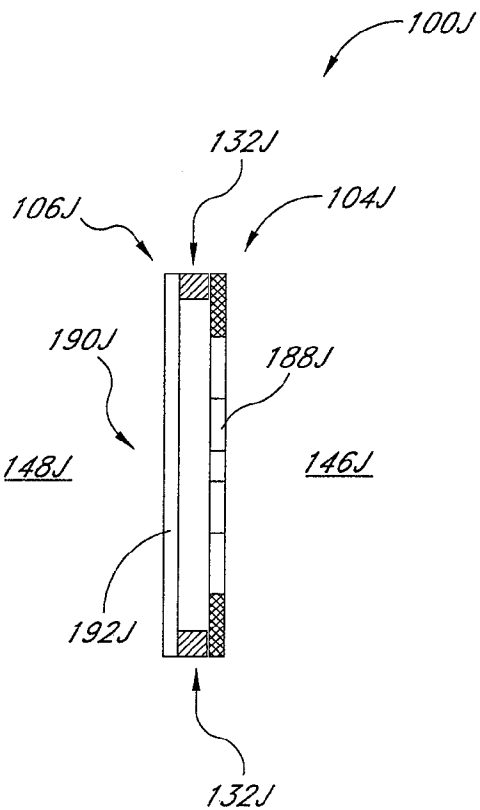
FIG. 10 is a schematic side elevational and partial sectional view of a modification of the window assembly shown in FIG. 2.

FIG. 10 illustrates a modification of the assembly 100A illustrated in FIG. 2, identified generally by the reference numeral 100J. Components of the window assembly 100J that correspond to components of window assembly 100A have been given the same reference numeral, except that a letter "J" has been added thereto.

In the embodiment illustrated in FIG. 10, the window assembly 100J preferably comprises a first window panel assembly 104J and a second window panel assembly 106J. The first window panel assembly 104J preferably comprises a stained glass window 188J. The stained glass window 188J can face an interior location 146J.

The second window panel assembly 106J preferably comprises a functional glass unit 190J, such as, for example, self-cleaning glass 192J. The functional glass unit 190J can provide features that the first window panel assembly 104J is lacking. The functional glass unit 190J can face an exterior location 148J.

One or more spacers 132J can be disposed between the first window panel assembly 104J and the second window panel assembly 106J. The spacers 132J can comprise a desiccant. As shown in FIG. 10, the window panel 100J preferably provides for a clean stained glass window 188J, or other glazing assembly, even when located in a hard to reach area.

Figure 11:
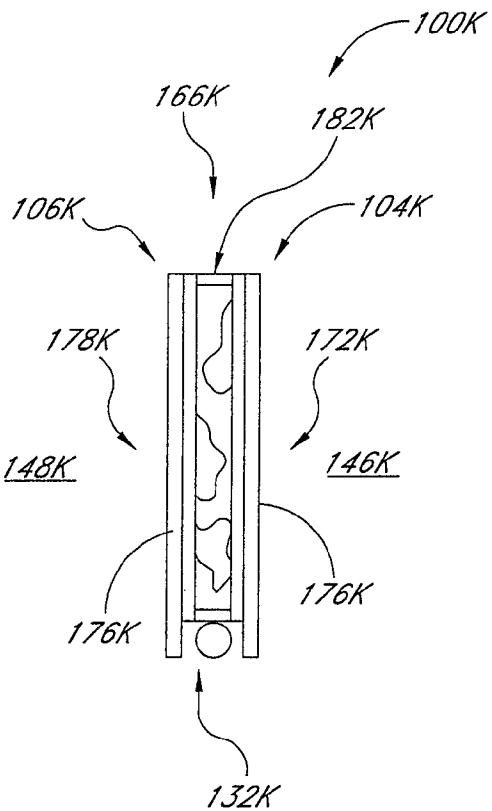
FIG. 11 is a schematic side elevational view of a modification of the window assembly shown in FIG. 2.

FIG. 11 illustrates a modification of the assembly 100A illustrated in FIG. 2, identified generally by the reference numeral 100K. Components of the window assembly 100K that correspond to components of window assembly 100A have been given the same reference numeral, except that a letter "K" has been added thereto.

In the embodiment illustrated in FIG. 11, the window assembly 100K preferably comprises a first window panel assembly 104K, a second window panel assembly 106K and a third window panel assembly 166K. The first window panel assembly 104K preferably comprises a first protective member 172K, such as, for example, safety glass 176K.

The second window panel assembly 106K preferably comprises a second protective member 178K, such as, for example, safety glass 176K. The third window panel assembly 166K preferably comprises a delicate member 182K, such as, for example, a colored water and oil-filled glass container, having a heating or lighting element. Such a device can form a function similar to what is known as a "lava lamp" in a window sized installation, or larger. The third window panel assembly 166K can be disposed between the first and second window panel assemblies 104K, 106K. As shown in FIG. 11, the window panel 100K preferably acts to surround and thus protects the container.

As shown and described with reference to FIGS. 1-11, features of preferred embodiments of the present inventions improve upon conventional glazing systems with the use of a plurality of panel assemblies and other improved glazing features. Some preferred embodiments provide additional thermal efficiency, preserve aesthetic characteristics, protect included members, or provide other functional advantages. Some of the applications and configurations of the improved glazing systems are discussed further herein. It should be noted that this application discusses multiple distinct features and not all of the features need to be present in any single embodiment of the present invention. Thus, in some embodiments a plurality of the features can be present while other features can not be present. Additionally, some embodiments will only reflect one of the features. Moreover, the features, aspects and advantages of the invention, as recited in the appended claims, can be applied in still other configurations within the scope of the invention, which will become apparent to those skilled in the art.

In some embodiments, a window assembly preferably comprises a wall system. Some exemplary embodiments having wall systems are illustrated in FIGS. 12-21.

Figure 13:
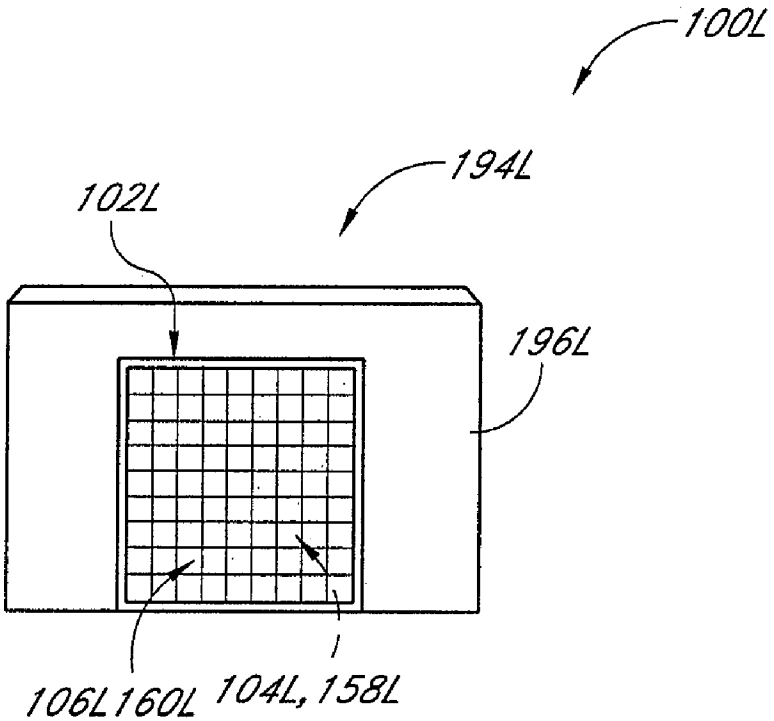
FIG. 13 is a perspective view of the window assembly of FIG. 12.
Figure 12:
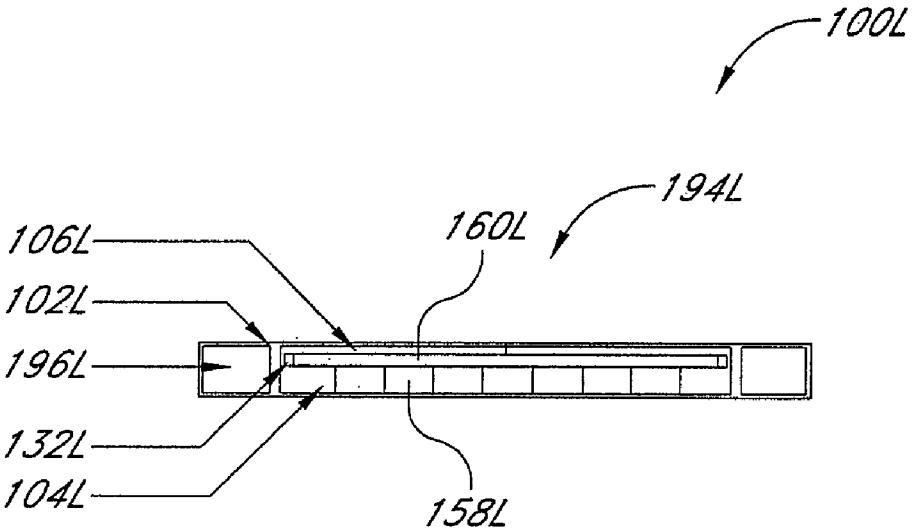
FIG. 12 is a sectional view of a modification of the window assembly shown in FIG. 2.

FIGS. 12 and 13 schematically illustrate a modification of the assembly 100A illustrated in FIG. 2, identified generally by the reference numeral 100L. Components of the window assembly 100L that correspond to components of window assembly 100A have been given the same reference numeral, except that a letter "L" has been added thereto.

In the embodiment illustrated in FIGS. 12 and 13, the window assembly 100L comprises a generally straight wall system 194L. The wall system 194L can have a frame 102L, a first window panel assembly 104L, and a second window panel assembly 106L. The first window panel assembly 104L can be a glass block assembly 158L. The second window panel assembly 106L can be a low-emissivity panel 160L.

The wall system 194L can include a spacer 132L between the first and second window panel assemblies 104L, 106L. The frame 102L preferably surrounds the first and second window panel assemblies 104L, 106L. The frame 102L can be coupled with a wall unit 196L. In the embodiment shown in FIGS. 12 and 13, the wall unit 196L and the wall system 194L are generally straight.

Figure 15:
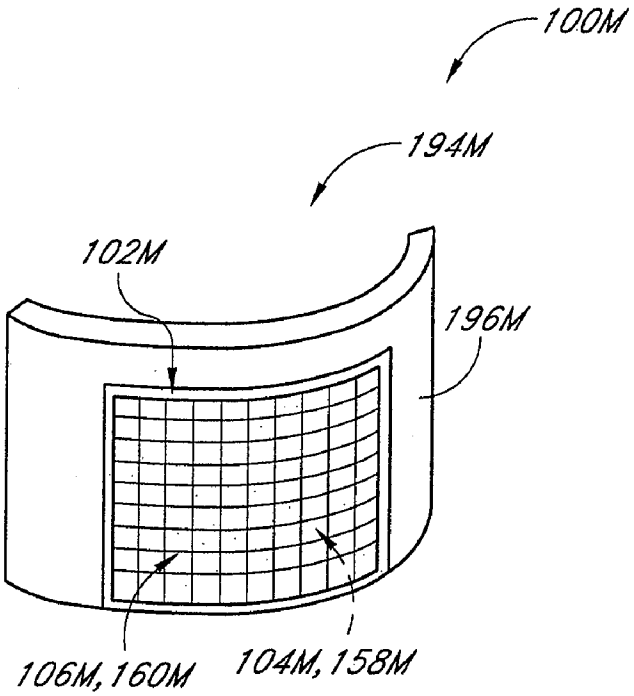
FIG. 15 is a perspective view of the window assembly of FIG. 14.
Figure 14:
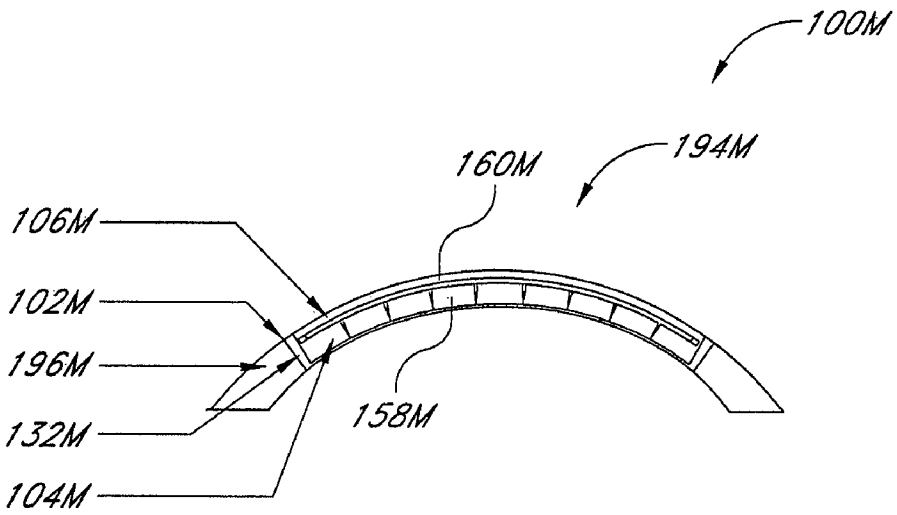
FIG. 14 is a sectional view of a modification of the window assembly shown in FIG. 2.

FIGS. 14 and 15 illustrate a modification of the assembly 100A illustrated in FIG. 2, identified generally by the reference numeral 100M. Components of the window assembly 100M that correspond to components of window assembly 100A have been given the same reference numeral, except that a letter "M" has been added thereto.

In the embodiment illustrated in FIGS. 14 and 15 the wall system 194M preferably comprises components as described above with reference to FIGS. 12 and 13. The wall system 194M of FIGS. 14 and 15, however, can be generally curved rather than generally straight.

Figure 17:
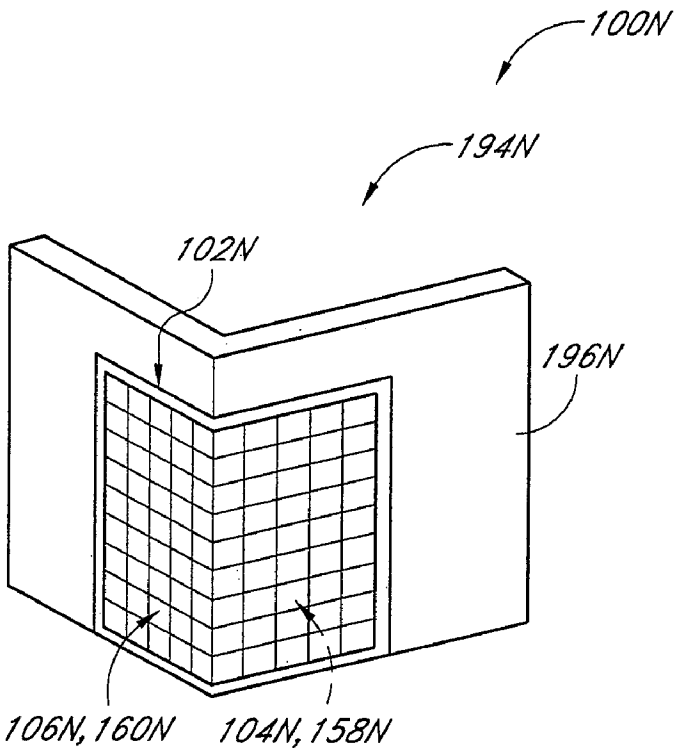
FIG. 17 is a perspective view of the window assembly of FIG. 16.
Figure 16:
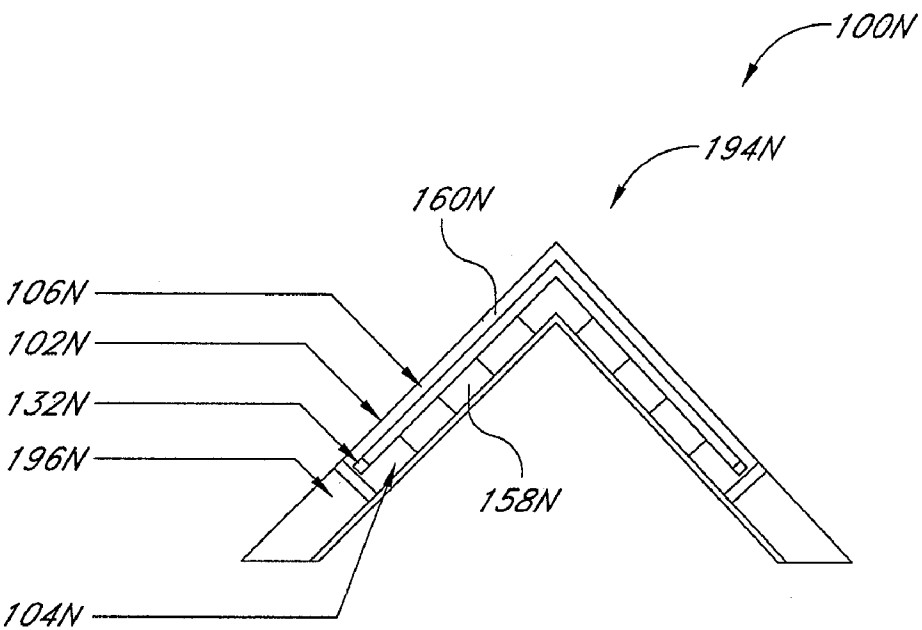
FIG. 16 is a sectional view of a modification of the window assembly shown in FIG. 2.

FIGS. 16 and 17 illustrate a modification of the assembly 100A illustrated in FIG. 2, identified generally by the reference numeral 100N. Components of the window assembly 100N that correspond to components of window assembly 100A have been given the same reference numeral, except that a letter "N" has been added thereto.

In the embodiment illustrated in FIGS. 16 and 17 the wall system 194N preferably comprises components as described above with reference to FIGS. 12 and 13. The wall system 194N of FIGS. 16 and 17, however, can be angled rather than generally straight or generally curved.

Figure 18:
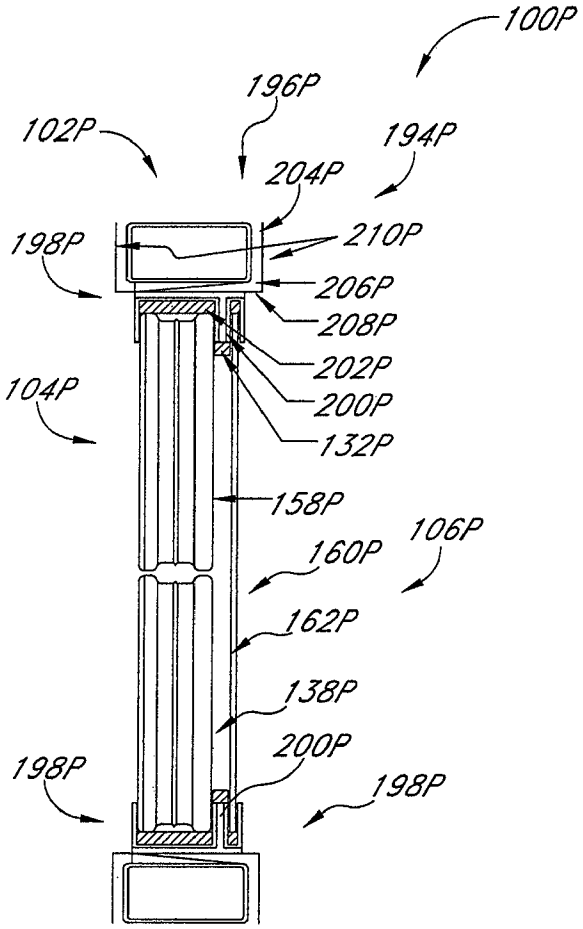
FIG. 18 is a schematic side elevational view and partial sectional view of a modification of the window assembly shown in FIG. 2.

FIG. 18 illustrates a modification of the assembly 100A illustrated in FIG. 2, identified generally by the reference numeral 100P. Components of the window assembly 100P that correspond to components of window assembly 100A have been given the same reference numeral, except that a letter "P" has been added thereto.

In the embodiment illustrated in FIG. 18, the window assembly 100P preferably comprises a wall system 194P. The wall system 194P can have a frame 102P, a first window panel assembly 104P, and a second window panel assembly 106P.

The frame 102P preferably comprises window panel support portions 198P and a channel 200P. The channel 200P can be configured to separate the first window panel assembly 104P from the second window panel assembly 106P.

The first window panel assembly 104P can be a glass block assembly 158P. The second window panel assembly 106P can be a low-emissivity panel 160P. The low-emissivity panel 160P can comprise a single pane 162P of low-E glass.

The frame 102P can also include a spacer 132P between the first and second window panel assemblies 104P, 106P. The spacer 132P can comprise a desiccant.

The first window panel assembly 104P, the second window panel assembly 106P, and the frame 102P can define a space 138P. The space 138P can provide an insulating function. For example, the space 138P can contain a gas as previously described. The space 138P can also be configured to include a weep system (not shown) as previously described.

The frame 102P preferably surrounds the first and second window panel assemblies 104P, 106P. Expansion material 202P can be located between the first window panel assembly 104P and the frame 102P, and between the second window panel assembly 106P and the frame 102P.

The frame 102P can be coupled with a wall unit 196P. The wall unit 196P preferably comprises studs 204P. Studs 204P can be made of steel or wood. Blocking members 206P can be located between the frame 102P and the studs 204P. Sealant 208P can be located between the frame 102P and the blocking members 206P. Interior and exterior finish 210P can surround the studs 204P and the blocking members 206P to provide an aesthetically pleasing appearance to the wall system 194P.

Figure 19:
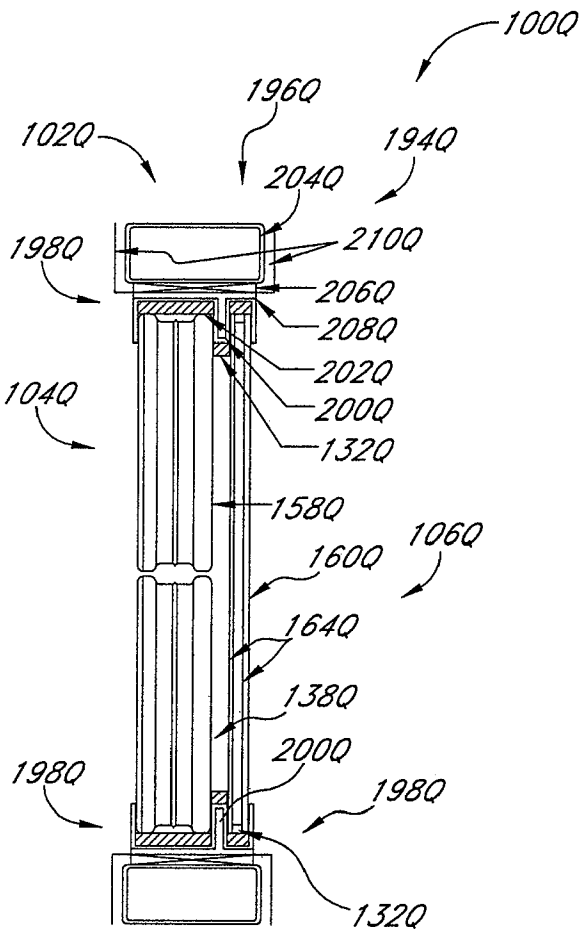
FIG. 19 is a schematic side elevational view and partial sectional view of a modification of the window assembly shown in FIG. 2.

FIG. 19 illustrates a modification of the assembly 100A illustrated in FIG. 2, identified generally by the reference numeral 100Q. Components of the window assembly 100Q that correspond to components of window assembly 100A have been given the same reference numeral, except that a letter "Q" has been added thereto.

In the embodiment illustrated in FIG. 19, the wall system 194Q comprises components as described above with reference to FIG. 18. The wall system 194Q of FIG. 19, however, can have a second window panel assembly 106Q with a low-emissivity panel 160Q having an IG glazing unit 164Q with at least two glazing members rather than the single glazing member 162P illustrated in FIG. 18. A spacer 132Q can be located between the glazing members of the IG glazing unit 164Q. The spacer 132Q preferably comprises a desiccant.

Figure 20:
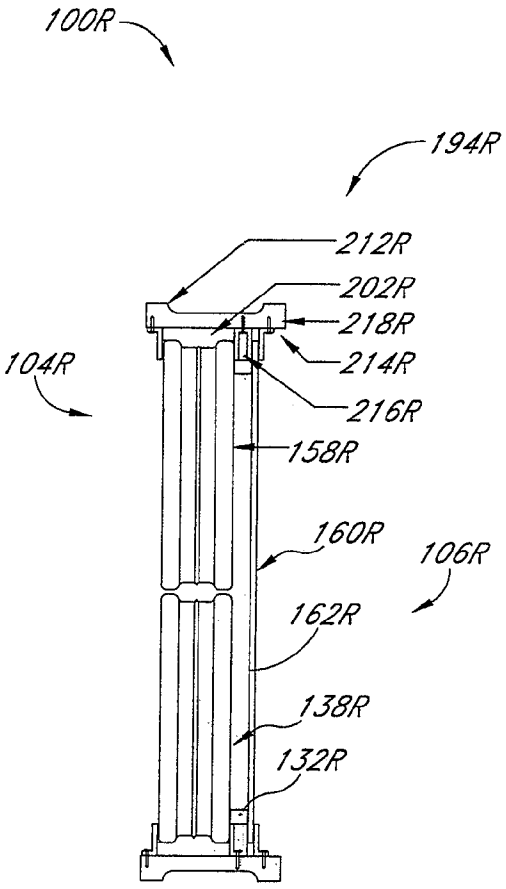
FIG. 20 is a schematic side elevational view and partial sectional view of a modification of the window assembly shown in FIG. 2.

FIG. 20 illustrates a modification of the assembly 100A illustrated in FIG. 2, identified generally by the reference numeral 100R. Components of the window assembly 100R that correspond to components of window assembly 100A have been given the same reference numeral, except that a letter "R" has been added thereto.

In the embodiment illustrated in FIG. 20, the window assembly 100R preferably comprises a wall system 194R. The wall system 194R of FIG. 20 is adapted for use with a masonry wall 212R. The wall system 194R can have a first window panel assembly 104R and a second window panel assembly 106R.

Rather than a frame, the wall system 194R comprises "L" shaped 214R and "U" shaped 216R members fastened with anchor bolts 218R to components of the masonry wall 212R. The "L" shaped 214R and "U" shaped 216R members secure the first and second window panel assemblies 104R, 106R in the proper configuration relative to the components of the masonry wall 212R. In some embodiments, the "L" shaped 214R and "U" shaped 216R members preferably are surface mounted to the components of the masonry wall 212R.

Alternatively, the "L" shaped 214R and "U" shaped 216R members can be recessed in the components of the masonry wall 212R. The anchor bolts 218R preferably are made of galvanized or stainless steel. The "U" shaped 216R member separates the first window panel assembly 104R from the second window panel assembly 106R.

The first window panel assembly 104R can be a glass block assembly 158R. The second window panel assembly 106R can be a low-emissivity panel 160R. The low-emissivity panel 160R preferably comprises a single pane 162R of low-E glass.

A spacer 132R can be located between the first and second window panel assemblies 104R, 106R. The spacer 132R can comprise a desiccant. The first window panel assembly 104R and the second window panel assembly 106R define a space 138R. The space 138R can have features as described herein.

Expansion material 202R can be located between the first window panel assembly 104R and the components of the masonry wall 212R. The expansion material 202R can be located between the second window panel assembly 106R and the components of the masonry wall 212R.

Figure 21:
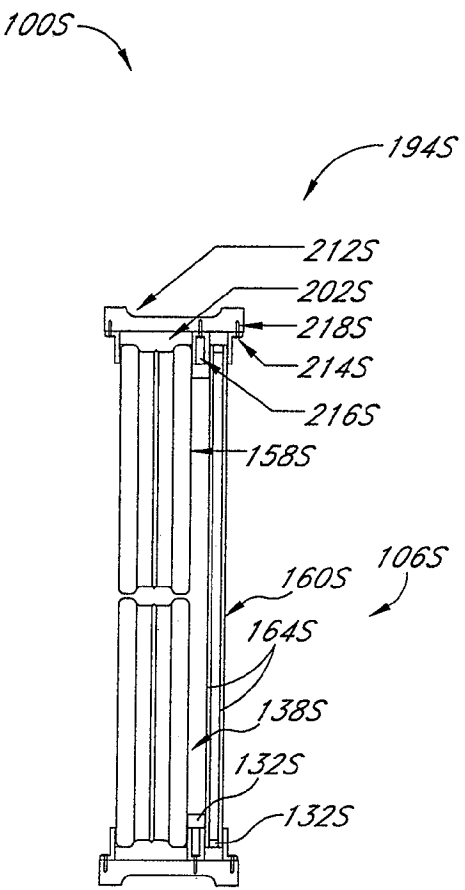
FIG. 21 is a schematic side elevational view and partial sectional view of a modification of the window assembly shown in FIG. 2.

FIG. 21 illustrates a modification of the assembly 100A illustrated in FIG. 2, identified generally by the reference numeral 100S. Components of the window assembly 100S that correspond to components of window assembly 100A have been given the same reference numeral, except that a letter "S" has been added thereto.

In the embodiment illustrated in FIG. 21, the wall system 194S preferably comprises components as described above with reference to FIG. 20. The wall system 194S of FIG. 21, however, can have a second window panel assembly 106S with a low-emissivity panel 160S having an IG glazing unit 164S with at least two glazing members rather than the single glazing member 162R illustrated in FIG. 20. A spacer 132S can be located between the glazing members of the IG glazing unit 164S. The spacer 132S can include a desiccant.

In some embodiments, a window assembly can be located in a wall or other surrounding structure. The window assembly can be configured in a plurality of shapes and sizes. FIGS. 22-26 illustrate various exemplary window assemblies.

Figure 22:
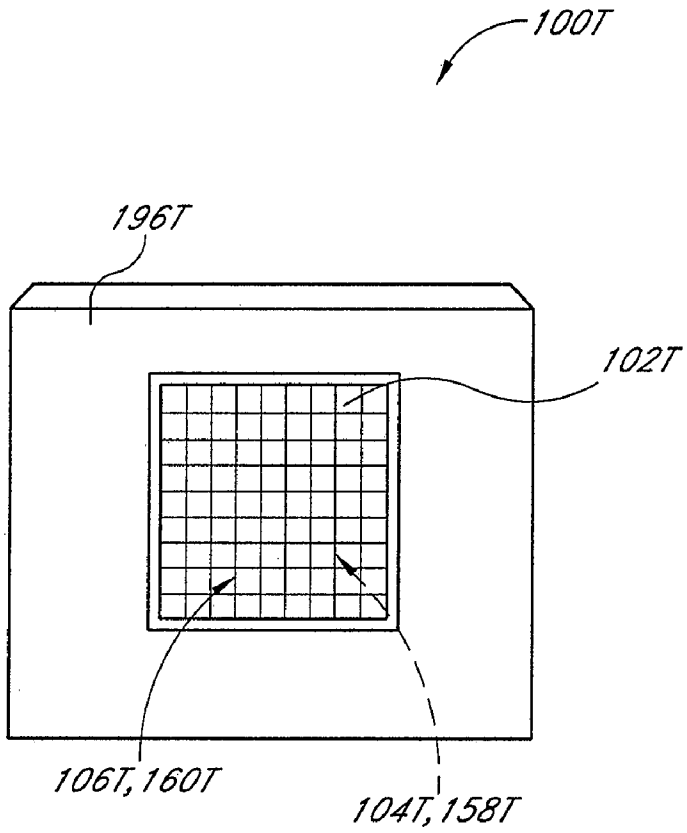
FIG. 22 is a perspective view of a modification of the window assembly shown in FIG. 2.

FIG. 22 illustrates a modification of the assembly 100A illustrated in FIG. 2, identified generally by the reference numeral 100T. Components of the window assembly 100T that correspond to components of window assembly 100A have been given the same reference numeral, except that a letter "T" has been added thereto.

In the embodiment illustrated in FIG. 22, the window assembly 100T preferably comprises a frame 102T, a first window panel assembly 104T, and a second window panel assembly 106T. The first window panel assembly 104T can be a glass block assembly 158T. The second window panel assembly 106T can be a low-emissivity panel 160T. However, other window panel assemblies 104T, 106T can be used. As shown in FIG. 22, the window assembly 100T can comprise first and second window panel assemblies 104T, 106T having square or rectangular shapes.

Figure 23:
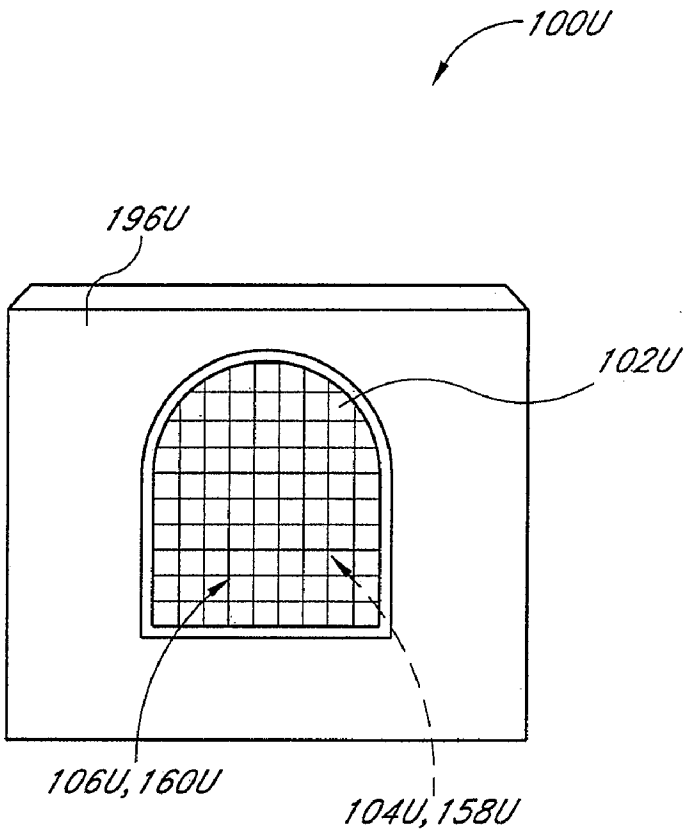
FIG. 23 is a perspective view of a modification of the window assembly shown in FIG. 2.

FIG. 23 illustrates a modification of the assembly 100A illustrated in FIG. 2, identified generally by the reference numeral 100U. Components of the window assembly 100U that correspond to components of window assembly 100A have been given the same reference numeral, except that a letter "U" has been added thereto.

In the embodiment illustrated in FIG. 23, the window assembly 100U preferably comprises components as described above with reference to FIG. 22. However, as shown in FIG. 23, a window assembly 100U can comprise first and second window panel assemblies 104U, 106U having a straight portion and an arcuate portion.

Figure 24:
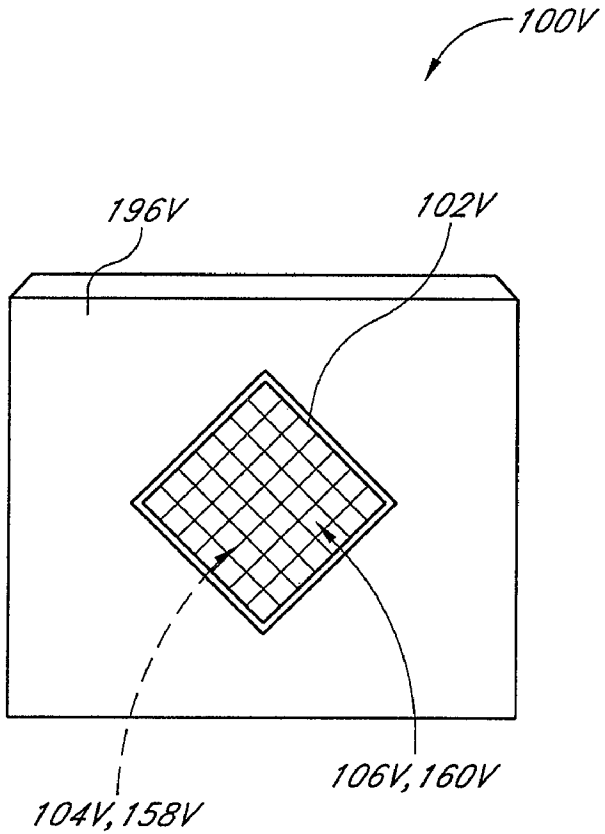
FIG. 24 is a perspective view of a modification of the window assembly shown in FIG. 2.

FIG. 24 illustrates a modification of the assembly 100A illustrated in FIG. 2, identified generally by the reference numeral 100V. Components of the window assembly 100V that correspond to components of window assembly 100A have been given the same reference numeral, except that a letter "V" has been added thereto.

In the embodiment illustrated in FIG. 24, the window assembly 100V preferably comprises components as described above with reference to FIG. 22. However, as shown in FIG. 24, a window assembly 100V can comprise first and second window panel assemblies 104V, 106V that are configured in a diamond shape.

Figure 25:
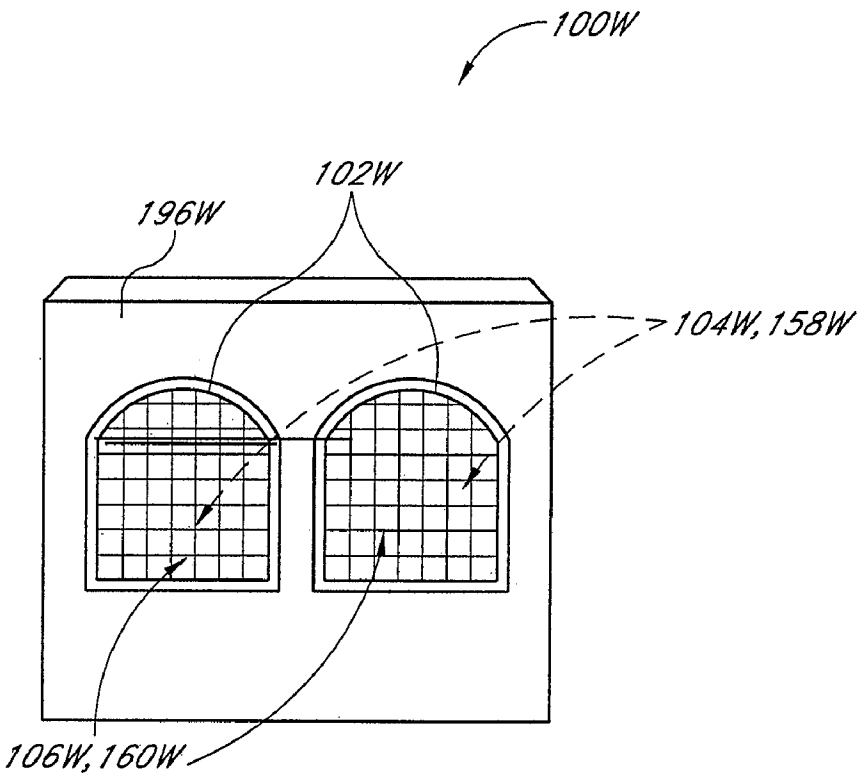
FIG. 25 is a perspective view of a modification of the window assembly shown in FIG. 2.

FIG. 25 illustrates a modification of the assembly 100A illustrated in FIG. 2, identified generally by the reference numeral 100W. Components of the window assembly 100W that correspond to components of window assembly 100A have been given the same reference numeral, except that a letter "W" has been added thereto.

In the embodiment illustrated in FIG. 25, the window assembly 100W preferably comprises components as described above with reference to FIG. 22. However, as shown in FIG. 25, a plurality of window assemblies 100W can be arranged together in a single wall 196W, each window assembly 100W comprising first and second window panel assemblies 104W, 106W.

Figure 26:
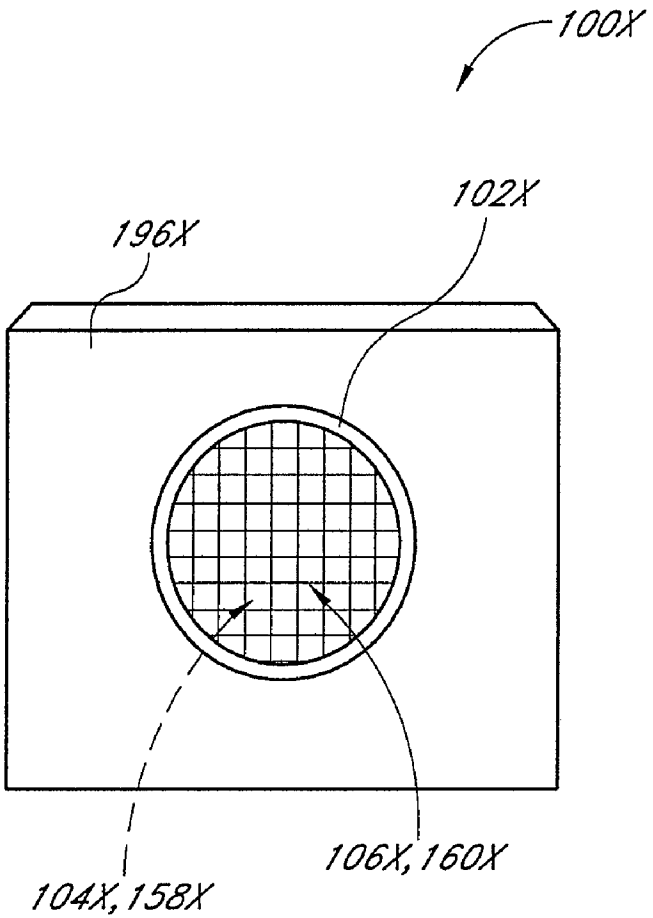
FIG. 26 is a perspective view of a modification of the window assembly shown in FIG. 2.

FIG. 26 illustrates a modification of the assembly 100A illustrated in FIG. 2, identified generally by the reference numeral 100X. Components of the window assembly 100X that correspond to components of window assembly 100A have been given the same reference numeral, except that a letter "X" has been added thereto.

In the embodiment illustrated in FIG. 26, the window assembly 100X preferably comprises components as described above with reference to FIG. 22. However, as shown in FIG. 26, a window assembly 100X can comprise first and second window panel assemblies 104X, 106X having arcuate portions or circular shapes. Window assemblies 100X and window panel assemblies 104X, 106X preferably can comprise any shape, size, or orientation, and can be arranged in any manner.

Figure 28:
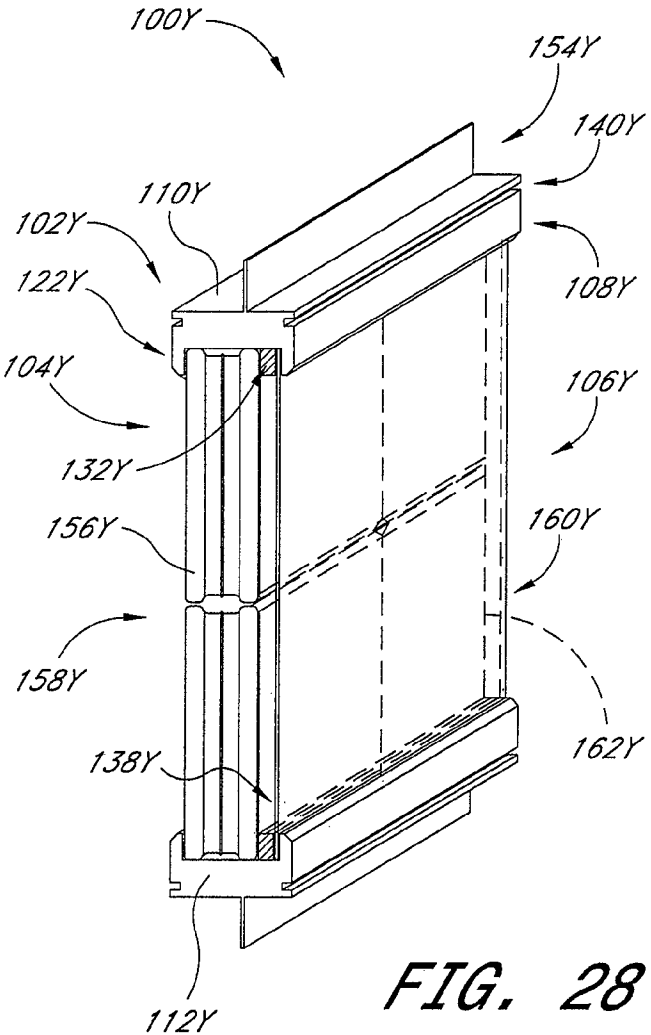
FIG. 28 is a perspective view of the window assembly of FIG. 27.
Figure 27:
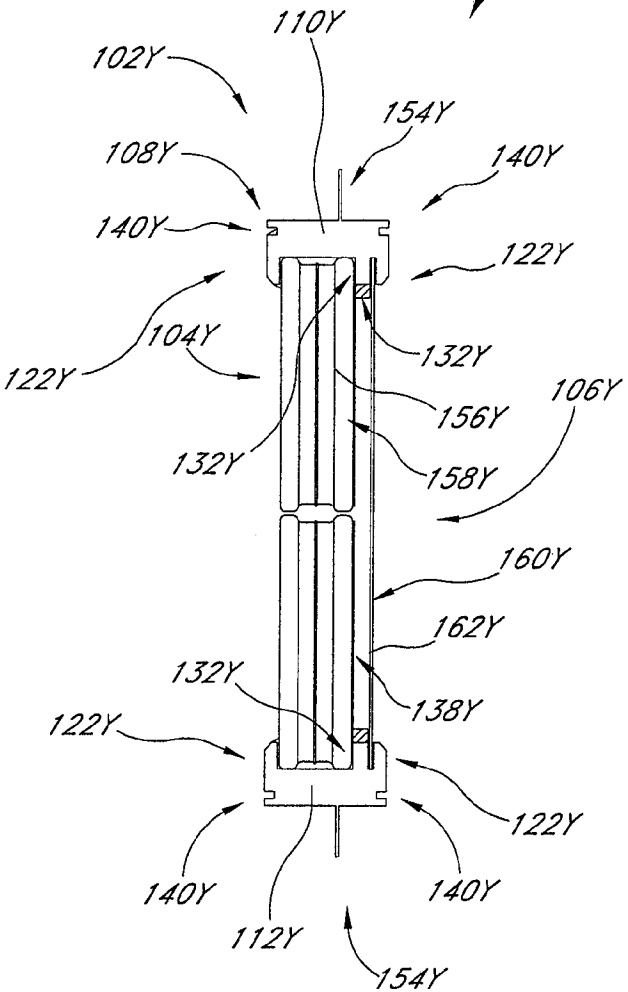
FIG. 27 is a schematic side elevational view and partial sectional view of a modification of the window assembly shown in FIG. 2.

FIGS. 27 and 28 illustrate a modification of the assembly 100A illustrated in FIG. 2, identified generally by the reference numeral 100Y. Components of the window assembly 100Y that correspond to components of window assembly 100A have been given the same reference numeral, except that a letter "Y" has been added thereto.

In FIGS. 27 and 28 the window assembly 100Y is similar to that described with reference to FIG. 2. The window assembly 100Y preferably comprises a frame 102Y, a first window panel assembly 104Y, and a second window panel assembly 106Y. The frame 102Y can be a window frame 108Y. The window frame 108Y can have an upper portion 110Y and a lower portion 112Y. The window frame 108Y can have side portions (not shown). The window frame 108Y can have one or more glazing bead assemblies 122Y.

As shown in FIGS. 27 and 28, glazing bead assemblies 122Y are coupled with the window frame 108Y. The window frame 108Y can have a spacer 132Y between the first window panel assembly 104Y and the second window panel assembly 106Y. The spacer 132Y can have a desiccant material.

The first window panel assembly 104Y, the second window panel assembly 106Y, and the window frame 108Y preferably define a space 138Y as described herein. The window frame 108Y can have an accessory pocket 140Y. In the illustrated embodiment, the window frame 108Y can have a flange 154Y. The window frame 108Y can also have a weep system (not shown).

As shown in FIGS. 27 and 28, the first window panel assembly 104Y comprises a plurality of glass blocks 156Y forming a glass block window 158Y. The glass block window 158Y can be supported by the window frame 108Y. The glass blocks 156Y have a non-specular surface. The glass blocks 156Y form a translucent glass block window 158Y. The glass blocks 156Y can be arranged in a pre-assembled fillet of blocks.

The second window panel assembly 106Y can be a low-emissivity panel 160Y. In the illustrated embodiment, the second window panel assembly 106Y can be a single glazing member 162Y. The low-emissivity panel 160Y can be juxtaposed to the glass block window 158Y. The window assembly 100Y illustrated in FIGS. 27 and 28 preferably provides an insulated interior and an aesthetically pleasing glass block window 158Y.

Figure 30:
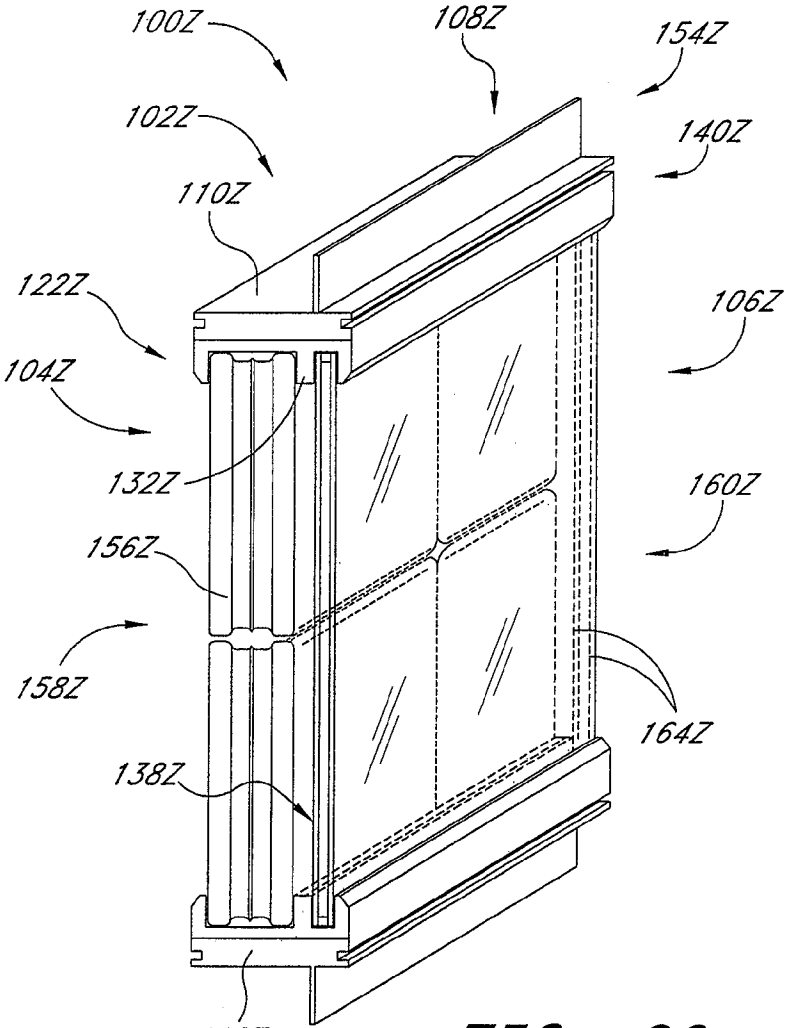
FIG. 30 is a perspective view of the window assembly of FIG. 29.
Figure 29:
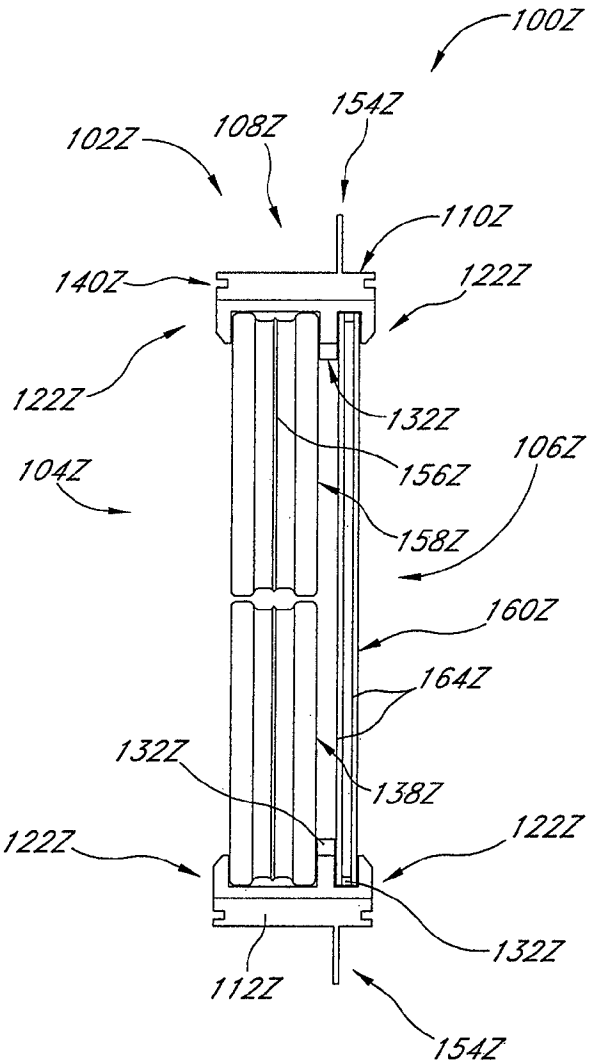
FIG. 29 is a schematic side elevational view and partial sectional view of a modification of the window assembly shown in FIG. 2.

FIGS. 29 and 30 illustrate a modification of the assembly 100A illustrated in FIG. 2, identified generally by the reference numeral 100Z. Components of the window assembly 100Z that correspond to components of window assembly 100A have been given the same reference numeral, except that a letter "Z" has been added thereto.

In FIGS. 29 and 30, the window assembly 100Z is similar to that described with reference to FIGS. 27 and 28. The window assembly 100Z preferably comprises components as described above with reference to FIGS. 27 and 28. The window assembly 100Z of FIGS. 29 and 30, however, can have a second window panel assembly 106Z with a low-emissivity panel 160Z having an IG glazing unit 164Z with at least two glazing members rather than the single glazing member 162Y illustrated in FIGS. 27 and 28. A spacer 132Z can be located between the glazing members of the IG glazing unit 164Z. The spacer 132Z can include a desiccant.

Figure 32:
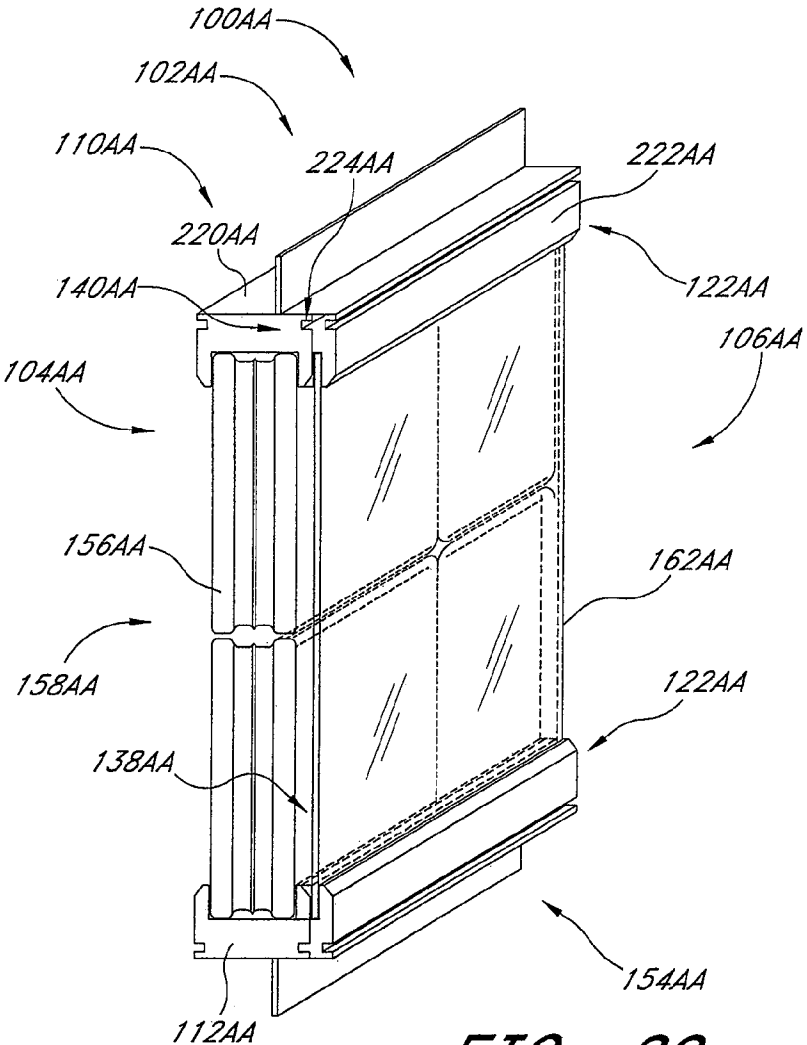
FIG. 32 is a perspective view of the window assembly of FIG. 31.
Figure 31:
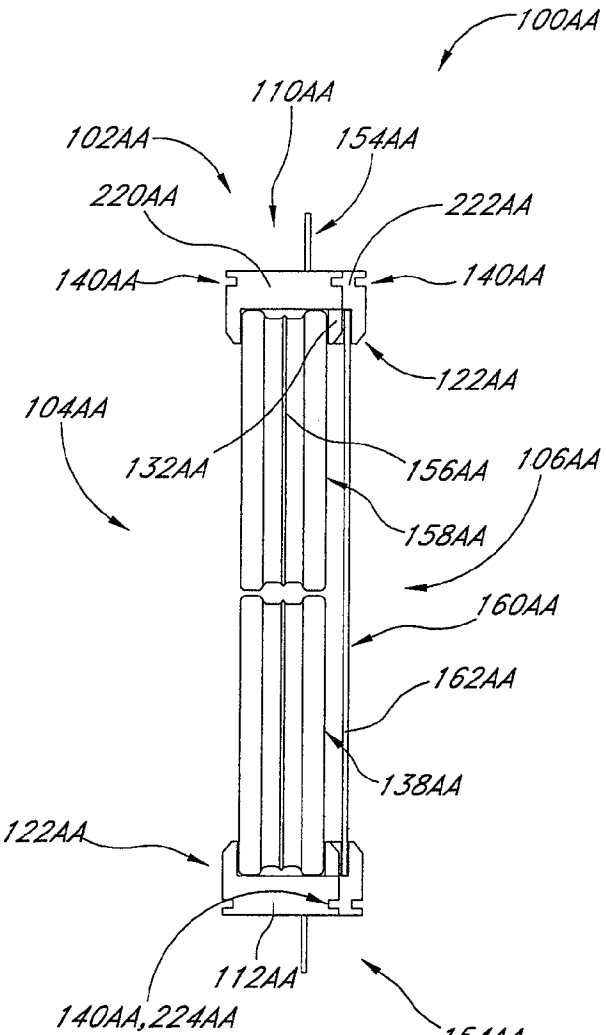
FIG. 31 is a schematic side elevational view of a modification of the window assembly shown in FIG. 2.

FIGS. 31 and 32 illustrate a modification of the assembly 100A illustrated in FIG. 2, identified generally by the reference numeral 100AA. Components of the window assembly 100AA that correspond to components of window assembly 100A have been given the same reference numeral, except that the letters "AA" have been added thereto.

In FIGS. 31 and 32, the window assembly 100AA is similar to that described with reference to FIGS. 27 and 28. The window assembly 100AA preferably comprises a frame 102AA, a first window panel assembly 104AA, and a second window panel assembly 106AA. The frame 102AA can be a window frame 108AA. The window frame 108AA can have first and second window frame members 220AA, 222AA. A first window frame member 220AA preferably houses a first window panel assembly 104AA. A second window frame member 222AA preferably houses a second window panel assembly 106AA.

A glazing bead assembly 122AA of the first window frame member 220AA can act as a spacer 132AA between the first and second window panel assemblies 220AA, 222AA. The first and second window frame members 220AA, 222AA preferably define accessory pockets 140AA.

A further advantage is provided where the second window frame member 222AA includes a protruding element 224AA configured to fit within an accessory pocket 140AA of the first window frame member 220AA. As such, the second window frame member 222AA can be coupled with the first window frame member 220AA such that the second window panel assembly 106AA is juxtaposed to the first window panel assembly 105AA with the protruding element 224AA anchored within the accessory pocket 140AA.

For example, the protruding element 224AA of the second window frame member 222AA can be fitted within an accessory pocket 140AA of the first window frame member 220AA to couple the first and second window frame members 220AA, 222AA. Thus, an existing window including an accessory pocket can be provided with an additional window.

In the illustrated embodiment, the first window frame member 220AA comprises a flange 154AA. In other embodiments, the second window frame member 222AA can include the flange 154AA.

As shown in FIGS. 31 and 32, the first window panel assembly 104AA preferably comprises a plurality of glass blocks 156AA forming a glass block window 158AA. The glass block window 158AA can be supported by the first window frame member 220AA. The second window panel assembly 106AA can be a low-emissivity panel 160AA. The low-emissivity panel 160AA can be supported by the second window frame member 222AA. In the illustrated embodiment, the second window panel assembly 106AA can be a single glazing member 162AA.

The window assembly 100AA illustrated in FIGS. 31 and 32 allows for a second window panel assembly 106AA to be coupled with a pre-existing window comprising a first window panel assembly 104AA housed in a first window frame member 220AA having an accessory pocket 140AA. The second window panel assembly 106AA is housed in a second window frame member 222AA that can be coupled with the first window frame member 220AA at an accessory pocket location 140AA on the first window frame member 220AA.

The protruding element 224AA of the second window frame member 222AA can be located within an accessory pocket 140AA of the first window frame member 220AA. In some embodiments, the protruding element 224AA can be formed integrally with the second window frame member 222AA. Alternatively, the protruding element 224AA can be formed as a separate element 226AA that is coupled with the second window frame member 222AA.

The protruding element 224AA can comprise a slide hook 228AA, described below in greater detail. Alternatively, protruding element 224AA can comprise a nail or screw. The protruding element 224AA can comprise any type of suitable means for fastening the first window frame member 220AA to the second window frame member 222AA. In the illustrated embodiment, the window assembly 100AA can be formed from a combination of new or existing window structures to provide an insulated interior and an aesthetically pleasing glass block window 158AA.

Figure 34:
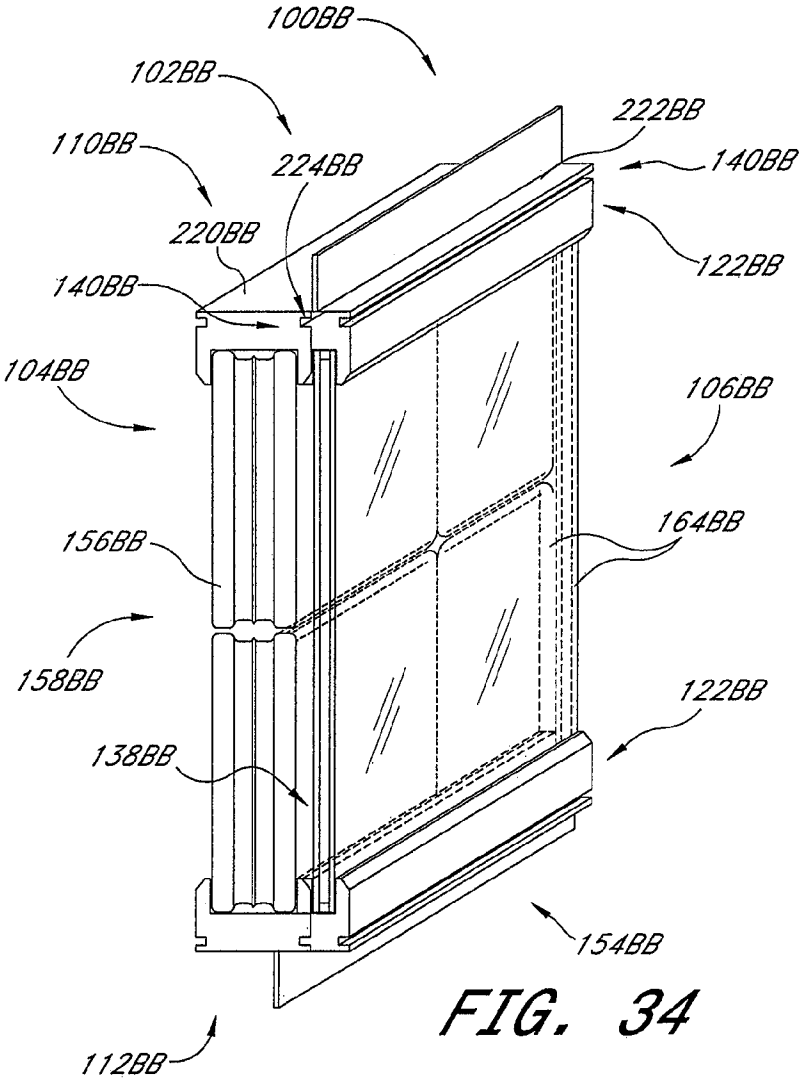
FIG. 34 is a perspective view of the window assembly of FIG. 33.
Figure 33:
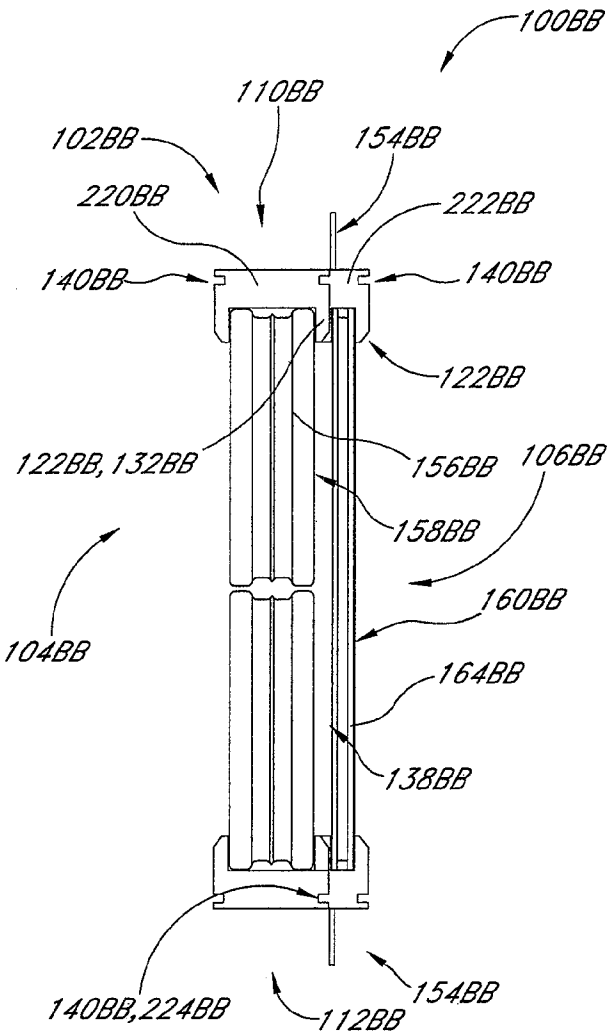
FIG. 33 is a schematic side elevational view of a modification of the window assembly shown in FIG. 2.

FIGS. 33 and 34 illustrate a modification of the assembly 100A illustrated in FIG. 2, identified generally by the reference numeral 100BB. Components of the window assembly 100BB that correspond to components of window assembly 100A have been given the same reference numeral, except that the letters "BB" have been added thereto.

In FIGS. 33 and 34 the window assembly 100BB is similar to that described with reference to FIGS. 31 and 32. The window assembly 100BB preferably comprises components as described above with reference to FIGS. 31 and 32. The window assembly 100BB of FIGS. 33 and 34, however, can have a second window panel assembly 106BB with a low-emissivity panel 160BB having an IG glazing unit 164BB with at least two glazing members rather than the single glazing member 162AA illustrated in FIGS. 31 and 32.

A spacer 132BB can be located between the glazing members of the IG glazing unit 164BB. The spacer 132BB can include a desiccant. Additionally, as illustrated in FIGS. 33 and 34, the second window frame member 222BB has a flange 154BB rather than the first window frame member 220BB. Either window frame member 220BB, 222BB can comprise the flange 154BB. In some embodiments, neither window frame member 220BB, 222BB preferably comprises the flange 154BB.

Figure 35:
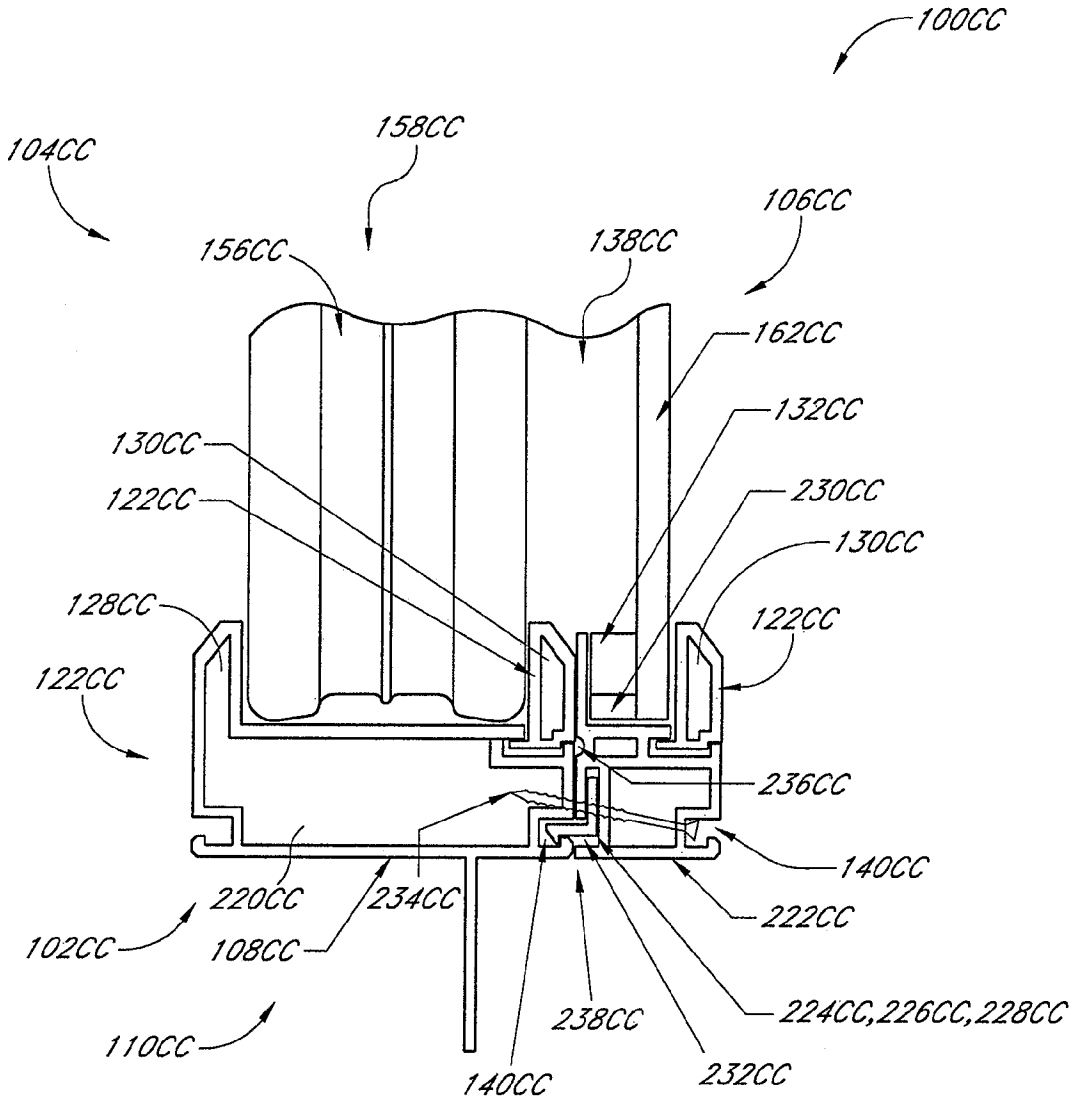
FIG. 35 is a schematic partial view and partial sectional view of a modification of the window assembly shown in FIG. 2.

FIG. 35 illustrates a modification of the assembly 100A illustrated in FIG. 2, identified generally by the reference numeral 100CC. Components of the window assembly 100CC that correspond to components of window assembly 100A have been given the same reference numeral, except that the letters "CC" have been added thereto.

In FIG. 35 the window assembly 100CC is similar to that described with reference to FIGS. 31 and 32. The window assembly 100CC preferably comprises components as described above with reference to FIGS. 31 and 32. FIG. 35 is an enlarged and sectional view of a bottom portion of one embodiment of the window assembly 100CC.

The window assembly 100CC preferably comprises a frame 102CC, a first window panel assembly 104CC, and a second window panel assembly 106CC. The window frame 108CC can have first and second window frame members 220CC, 222CC. The first window frame member 220CC houses the first window panel assembly 104CC. The second window frame member 222CC houses the second window panel assembly 106CC. The first window frame member 220CC can comprise a removable glazing bead 130CC and a fixed glazing bead 128CC.

The second window frame member 222CC preferably comprises a removable glazing bead 130CC. The second window frame member 222CC can include a spacer 132CC. The spacer 132CC can comprise a desiccant. The spacer 132CC can be coupled with the second window frame member 222CC with a butyl or silicone seal 230CC.

The first window panel assembly 104CC, the second window panel assembly 106CC, and the window frame 108CC preferably define a space 138CC. The space 138CC can be an airtight space to prevent condensation. The space 138CC can comprise air, argon, krypton, or other gases to increase thermal performance.

The first and second window frame members 220CC, 222CC can have accessory pockets 140CC. The second window frame member 222CC can include a protruding element 224CC sized to fit within the accessory pocket 140CC of the first frame member 220CC.

As shown in FIGS. 31 and 32, the first window panel assembly 104CC preferably includes a glass block window 158CC. The glass block window 158CC can be supported by the first window frame member 220CC. The second window panel assembly 106CC can be a low-emissivity panel 160CC. The low-emissivity panel 160CC can be supported by the second window frame member 222CC. In the illustrated embodiment, the second window panel assembly 106CC can be a single glazing member 162CC.

In the illustrated embodiment, the protruding element 224CC of the second window frame member 222CC can be located within the accessory pocket 140CC of the first window frame member 220CC. The protruding element 224CC is formed as a separate element 226CC that is coupled with the second window frame member 222CC. The protruding element 224CC can comprise a slide hook 228CC. The second window frame member 222CC preferably defines a slide hook pocket 232CC.

The slide hook pocket 232CC houses a portion of the slide hook 228CC in the second window frame member 222CC. The slide hook 228CC and slide hook pocket 232CC can be of various suitable configurations. Some exemplary configurations are described further below. In some embodiments, the slide hook 228CC, can slide up or down within the slide hook pocket 232CC, to allow for adjustment to facilitate coupling or to compensate for size differences between first and second window frame members 220CC, 222CC. One or more mechanical fasteners 234CC can also be used to couple the second window frame member 222CC with the first window frame member 220CC. Mechanical fasteners 234CC, such as, for example, screws, can be placed in the accessory pocket 140CC of the second window frame member 222CC and secured through the second window frame member 222CC with the first window frame member 220CC.

A first chamber 236CC, or first seal location, can be defined in the first or second window frame members 220CC, 222CC and configured to receive silicone or other sealing materials, such as, for example, glazing tape, VHB tape, or ultra high bond tape, to create an air-tight seal between the first and second window frame members 220CC, 222CC. A second seal location 238CC preferably is configured to receive silicone, or other sealant, preferably to prevent moisture from entering a gap between the first and second window frame members 220CC, 222CCC.

Figure 36:
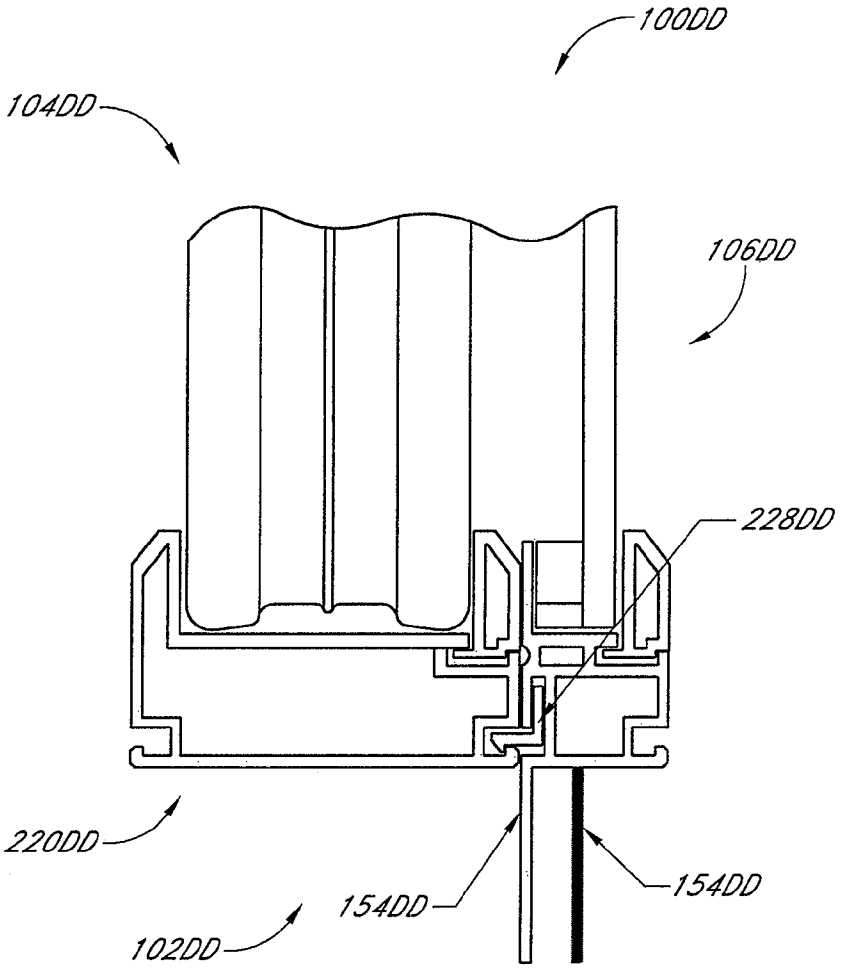
FIG. 36 is a schematic partial view and partial sectional view of a modification of the window assembly shown in FIG. 2.

Various other arrangements, couplers and connections will be apparent to those skilled in the art. Some other embodiments are described below with reference to FIGS. 36-42. FIG. 36 illustrates a modification of the assembly 100A illustrated in FIG. 2, identified generally by the reference numeral 100DD. Components of the window assembly 100DD that correspond to components of window assembly 100A have been given the same reference numeral, except that the letters "DD" have been added thereto.

In FIG. 36 the window assembly 100DD is similar to that described with reference to FIG. 35. The window assembly 100DD preferably comprises components as described above with reference to FIG. 35. As shown in FIG. 36, however, the flange 154DD is located on the second window frame member 222DD. The flange 154DD can be positioned in a first location or a second location as shown by the dashed lines.

In some embodiments, the second window frame member 222DD can be formed or extruded having a one or plurality of fins 154DD. One or more of the fins 154DD can be trimmed off prior to installation depending on the circumstances of the installation. In the embodiment shown, a slide hook 228DD couples the first and second window frame members 220DD, 222DD.

Figure 37:
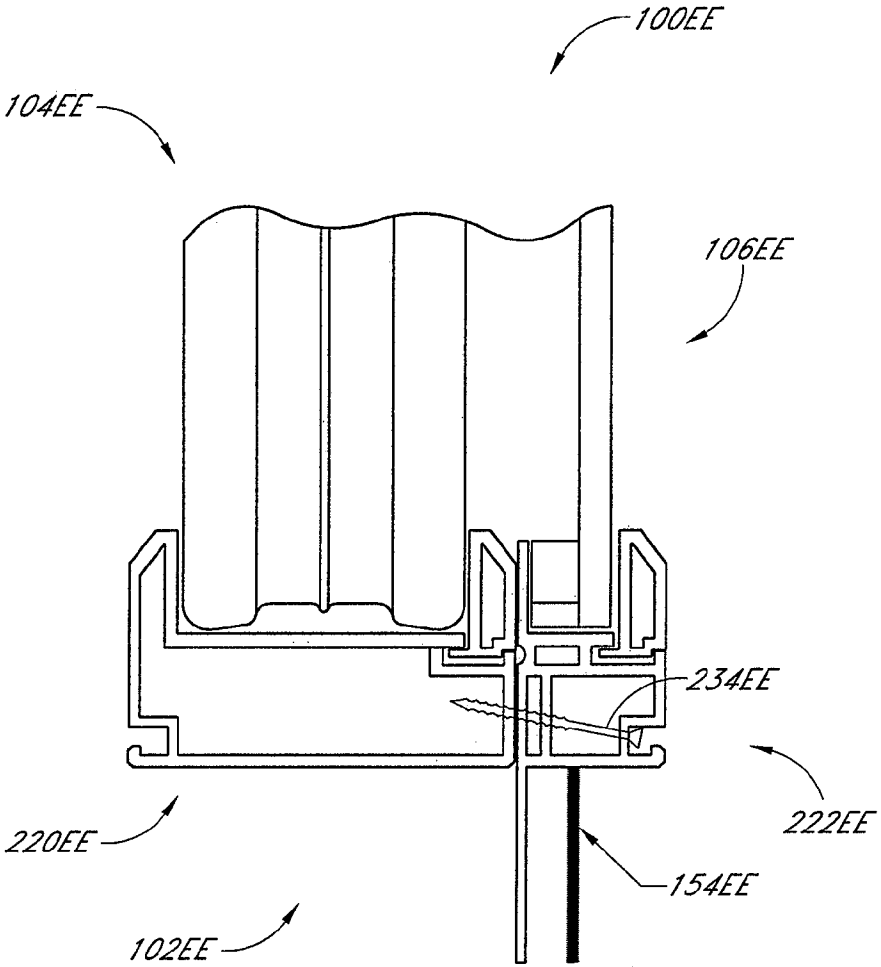
FIG. 37 is a schematic partial view and partial sectional view of a modification of the window assembly shown in FIG. 2.

FIG. 37 illustrates a modification of the assembly 100A illustrated in FIG. 2, identified generally by the reference numeral 100EE. Components of the window assembly 100EE that correspond to components of window assembly 100A have been given the same reference numeral, except that the letters "EE" have been added thereto.

In FIG. 37 the window assembly 100EE is similar to those described with reference to FIGS. 35 and 36. The window assembly 100EE preferably comprises components as described above with reference to FIGS. 35 and 36. As shown in FIG. 37, however, a mechanical fastener 234EE, or chemical fastener such as adhesives, VHB tape, or ultra high bond tape, is used to couple the first and second window frame members 220EE, 222EE where the first window frame member 220EE does not have an accessory pocket.

Figure 38:
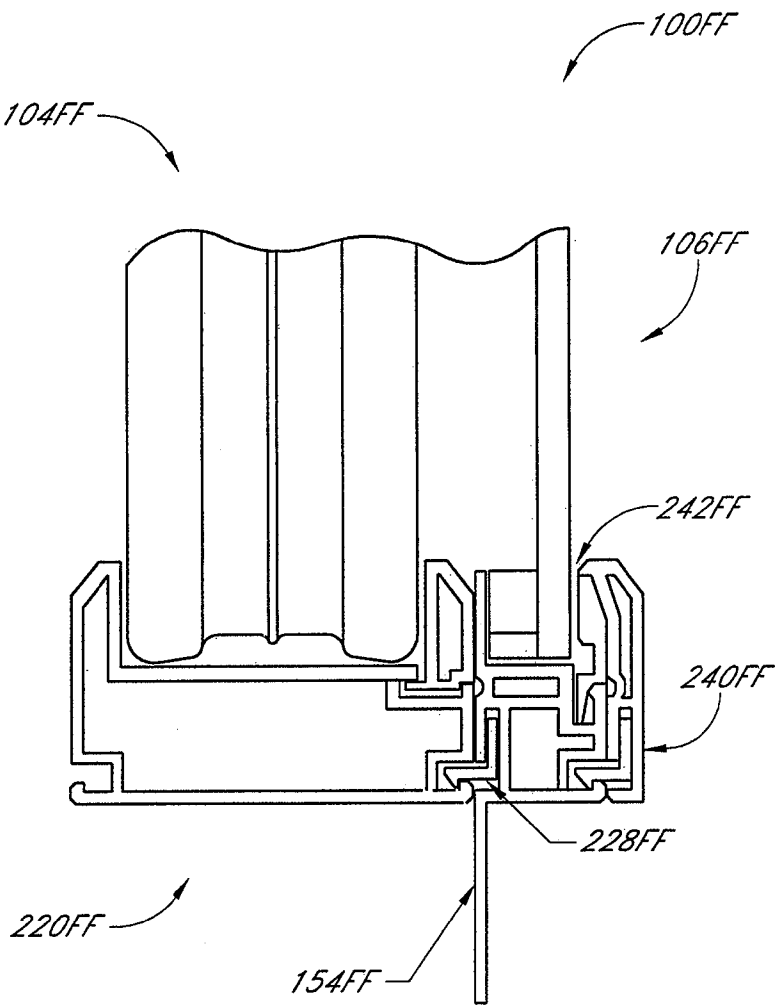
FIG. 38 is a schematic partial view and partial sectional view of a modification of the window assembly shown in FIG. 2.

FIG. 38 illustrates a modification of the assembly 100A illustrated in FIG. 2, identified generally by the reference numeral 100FF. Components of the window assembly 100FF that correspond to components of window assembly 100FF have been given the same reference numeral, except that the letters "FF" have been added thereto.

In FIG. 38 the window assembly 100FF is similar to those described previously. The window assembly 100FF preferably comprises components as described above with reference to FIG. 35. As shown in FIG. 38, however, a flange 154FF is located on the second window frame member 222FF. The second window frame member 222FF has a smaller profile and is coupled with a custom cladding 240FF that can match the frame profile of the first window frame member 220FF. The custom cladding 240FF can be coupled with the second window frame member 222FF at a bottom location with a slide hook 228FF and at a top location with a tip hook 242FF.

Figure 39:
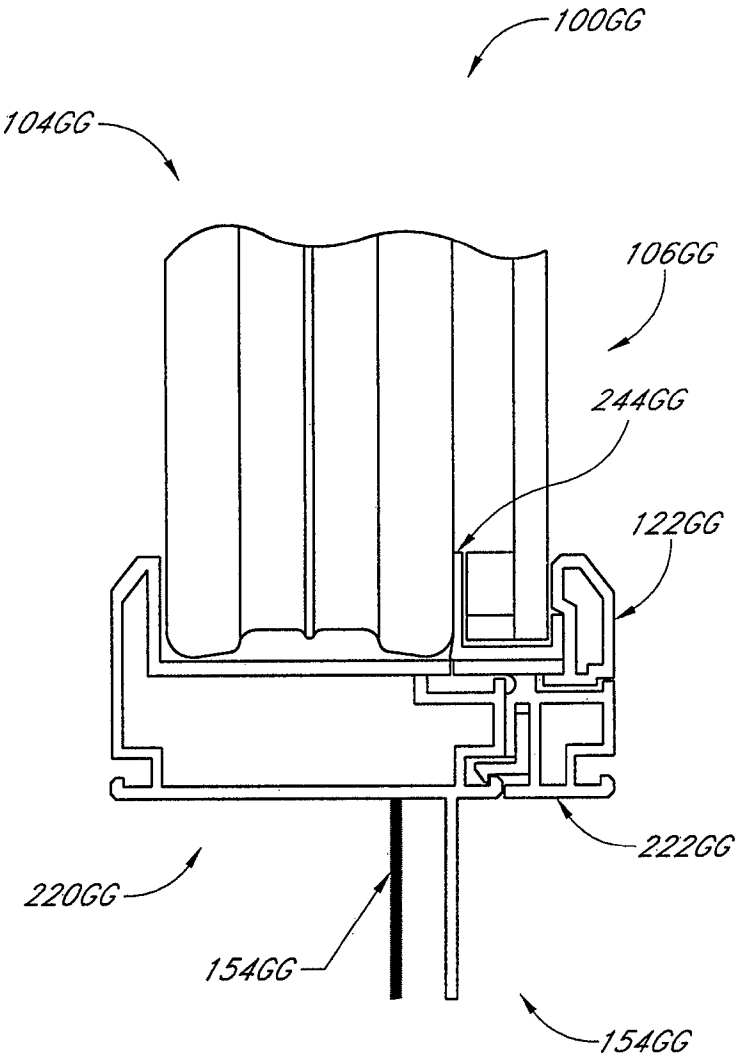
FIG. 39 is a schematic partial view and partial sectional view of a modification of the window assembly shown in FIG. 2.

FIG. 39 illustrates a modification of the assembly 100A illustrated in FIG. 2, identified generally by the reference numeral 100GG. Components of the window assembly 100GG that correspond to components of window assembly 100A have been given the same reference numeral, except that the letters "GG" have been added thereto.

In FIG. 39 the window assembly 100GG is similar to those described previously. The window assembly 100GG preferably comprises components as described above with reference to FIG. 35. As shown in FIG. 39, however, a flange 154GG can be located on the first window frame member 220GG at a first or second location. As shown in FIG. 39, a rigid channel 244GG is coupled with the second window frame member 222GG to control the transfer of force of a glazing bead assembly 122GG to place a greater force on the first window panel assembly 104GG rather than on the more fragile second panel assembly 106GG. The rigid channel 244GG replaces the glazing bead 130CC of the first window frame member 220CC as shown in FIG. 35.

Figure 40:
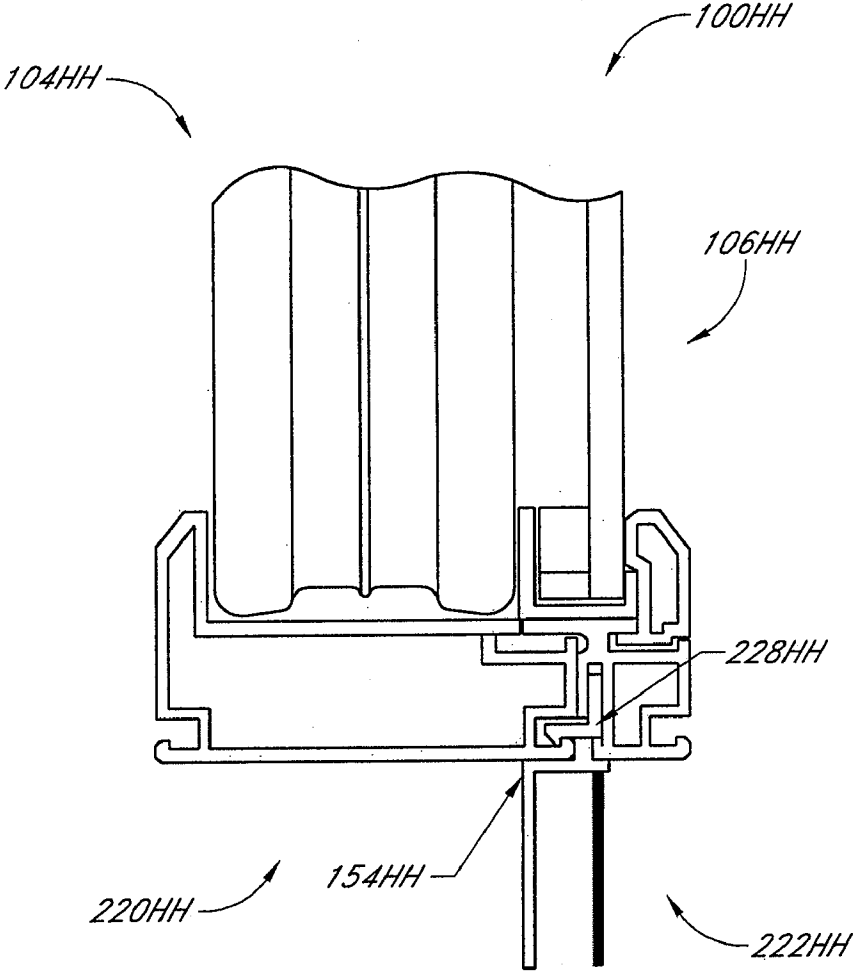
FIG. 40 is a schematic partial view and partial sectional view of a modification of the window assembly shown in FIG. 2.

FIG. 40 illustrates a modification of the assembly 100A illustrated in FIG. 2, identified generally by the reference numeral 100HH. Components of the window assembly 100HH that correspond to components of window assembly 100A have been given the same reference numeral, except that the letters "HH" have been added thereto.

In FIG. 40 the window assembly 100HH is similar to those described previously. The window assembly 100HH preferably comprises components as described above with reference to FIGS. 35 and 39. As shown in FIG. 40, however, a flange 154HH, located on the first window frame member 220HH, can be integrally formed with the slide hook 228HH to provide a specific flange setback that fits tightly against the first window frame member 220HH.

Figure 41:
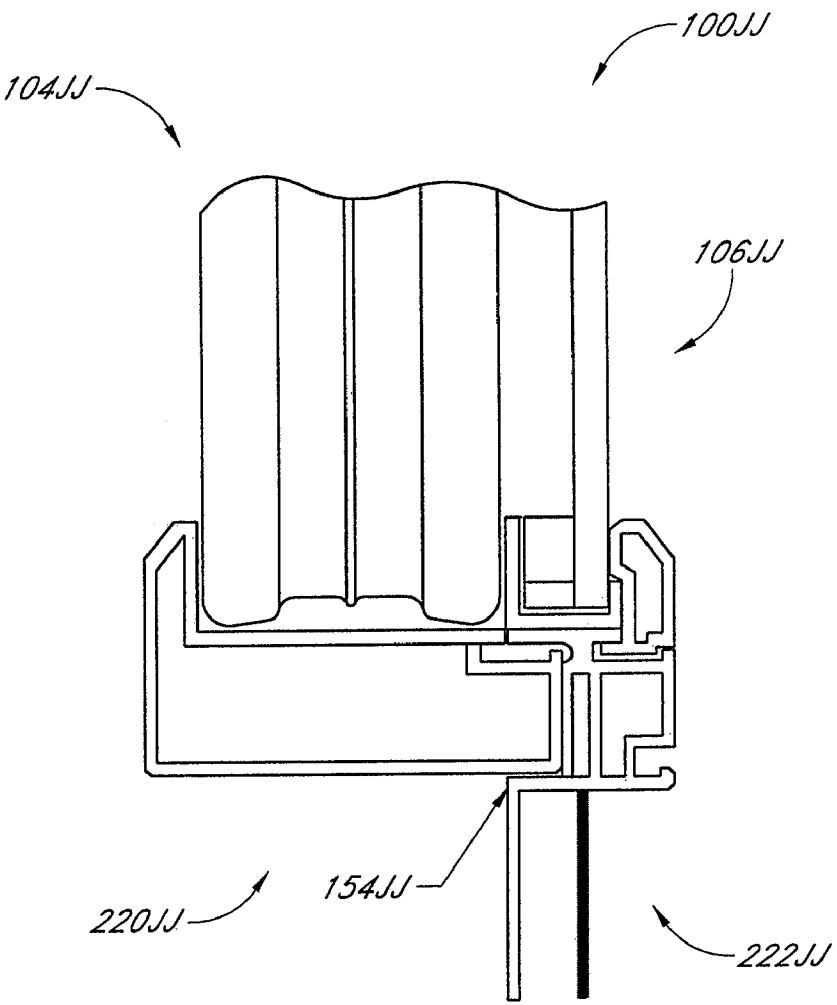
FIG. 41 is a schematic partial view and partial sectional view of a modification of the window assembly shown in FIG. 2.

FIG. 41 illustrates a modification of the assembly 100A illustrated in FIG. 2, identified generally by the reference numeral 100JJ. Components of the window assembly 100JJ that correspond to components of window assembly 100A have been given the same reference numeral, except that the letters "JJ" have been added thereto.

In FIG. 41 the window assembly 100JJ is similar to those described previously. The window assembly 100JJ preferably comprises components as described above with reference to FIG. 35, 37 and 39. As shown in FIG. 41, however, a fully-welded flange 154JJ can be integral to the second window frame member 222JJ. The second window frame member 222JJ can be slightly larger than the first window frame member 220JJ. A mechanical fastener such as screws or nails, or chemical fasteners such as adhesives, VHB tape, or ultra high bond tape, is used to couple the first and second window frame members 220JJ, 222JJ.

Figure 42:
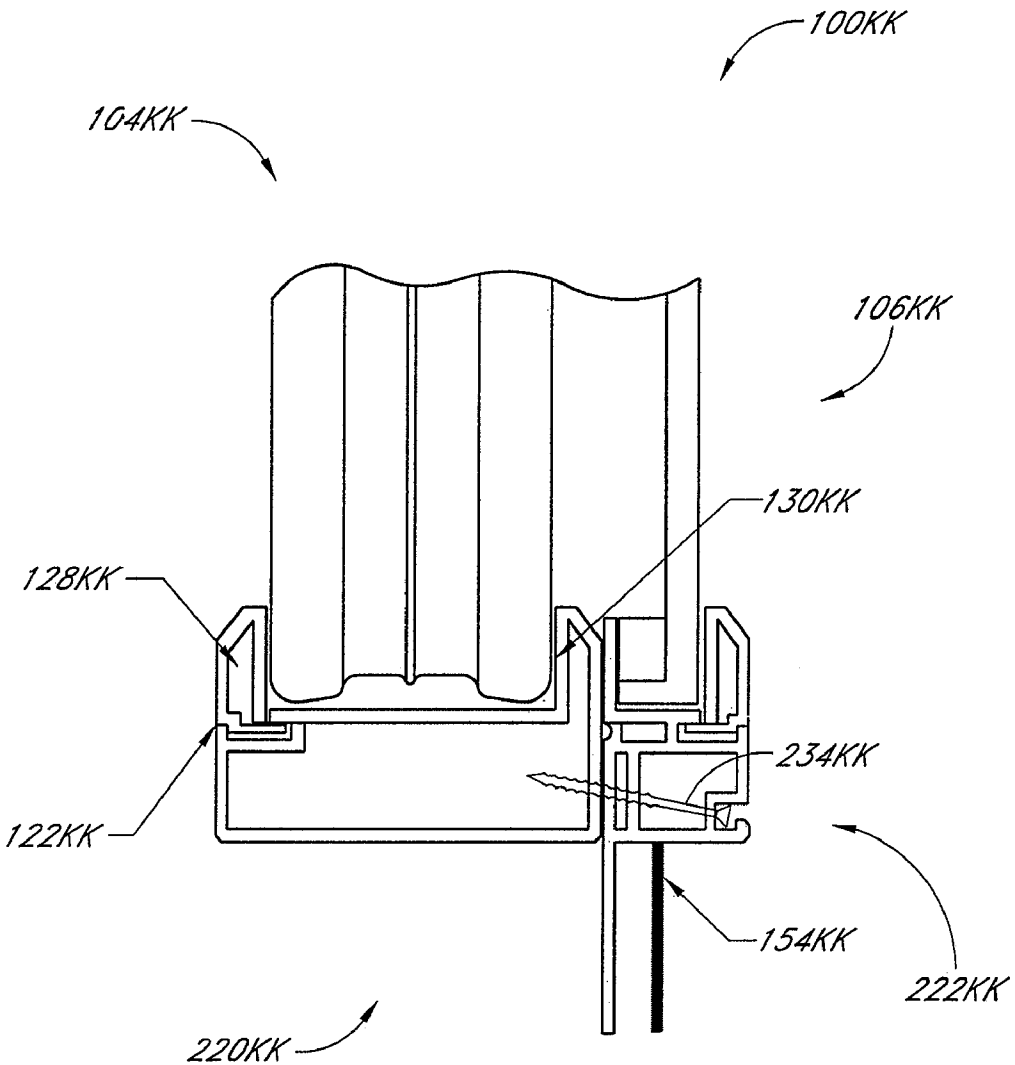
FIG. 42 is a schematic partial view and partial sectional view of a modification of the window assembly shown in FIG. 2.

FIG. 42 illustrates a modification of the assembly 100A illustrated in FIG. 2, identified generally by the reference numeral 100KK. Components of the window assembly 100KK that correspond to components of window assembly 100A have been given the same reference numeral, except that the letters "KK" have been added thereto.

In FIG. 42 the window assembly 100KK is similar to those described in FIGS. 35 and 37. The window assembly 100KK preferably comprises components as described above with reference to FIGS. 35 and 37. As shown in FIG. 42, however, the first window frame member 220KK can have a fixed glazing bead 130KK located on a side of the first window frame member 220KK closest to the second window frame member 222KK. The first window frame member 220KK can have a removable glazing bead 128KK located on a side of the first window frame member 220KK away from the second window frame member 222KK.

Figure 43:
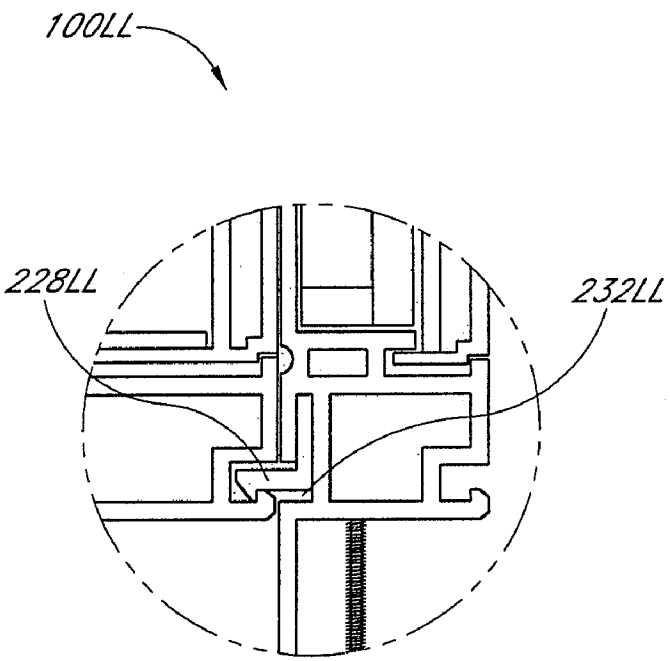
FIG. 43 is a schematic partial view and partial sectional view of a modification of the window assembly shown in FIG. 2.

FIGS. 43-48 illustrate various exemplary embodiments of a window assembly having a slide hook and a slide hook pocket. FIG. 43 illustrates a modification of the assembly 100A illustrated in FIG. 2, identified generally by the reference numeral 100LL. Components of the window assembly 100LL that correspond to components of window assembly 100A have been given the same reference numeral, except that the letters "LL" have been added thereto.

In FIG. 43 the window assembly 100LL has a slide hook 228LL and a slide hook pocket 232LL. The slide hook 228LL is generally L-shaped. The slide hook pocket 232LL extends generally vertically to allow the slide hook 228LL to be adjusted within the slide hook pocket 232LL.

Figure 44:
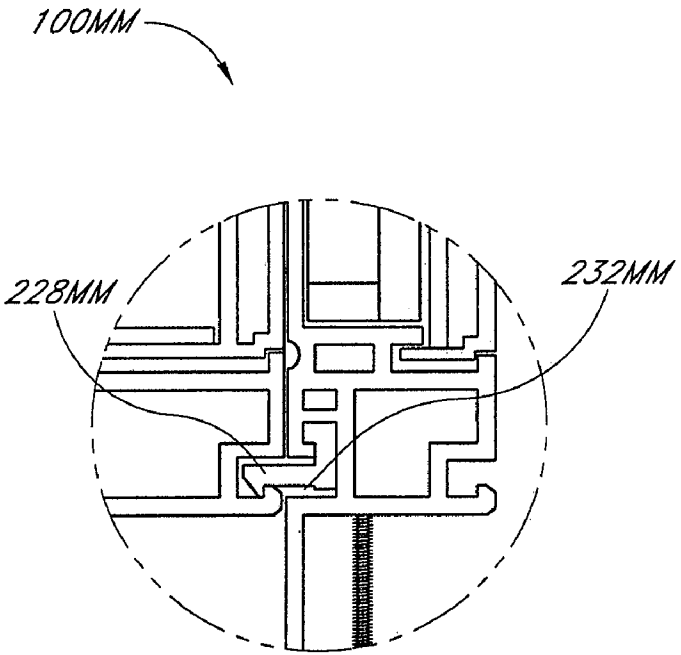
FIG. 44 is a schematic partial view and partial sectional view of a modification of the window assembly shown in FIG. 2.

FIG. 44 illustrates a modification of the assembly 100A illustrated in FIG. 2, identified generally by the reference numeral 100MM. Components of the window assembly 100MM that correspond to components of window assembly 100A have been given the same reference numeral, except that the letters "MM" have been added thereto.

In FIG. 44 the window assembly 100MM has a slide hook 228MM and a slide hook pocket 232MM. The slide hook 228MM has at least one tab that extends into a notch in the slide hook pocket 232MM.

Figure 45:
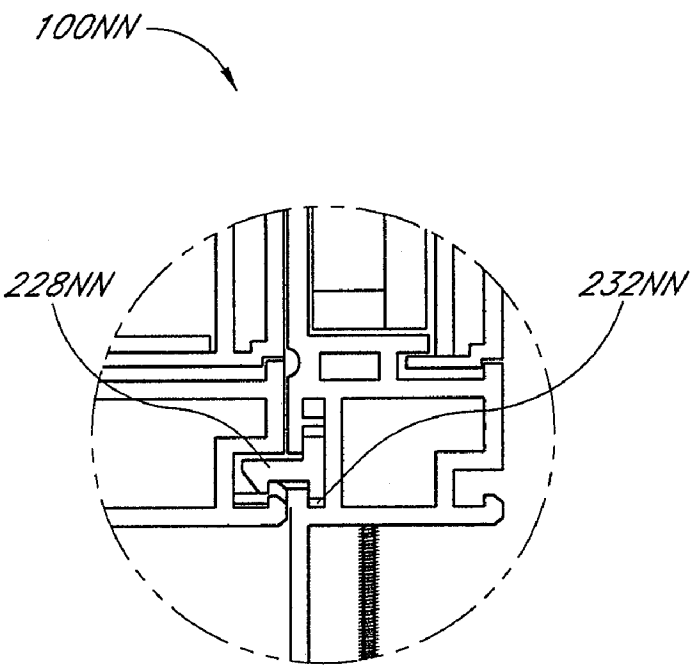
FIG. 45 is a schematic partial view and partial sectional view of a modification of the window assembly shown in FIG. 2.

FIG. 45 illustrates a modification of the assembly 100A illustrated in FIG. 2, identified generally by the reference numeral 100NN. Components of the window assembly 100NN that correspond to components of window assembly 100A have been given the same reference numeral, except that the letters "NN" have been added thereto.

In FIG. 45 the window assembly 100NN has a slide hook 228NN and a slide hook pocket 232NN. The slide hook 228NN is generally T-shaped. The slide hook pocket 232NN extends generally vertically to allow the slide hook 228NN to be adjusted within the slide hook pocket 232NN.

Figure 46:
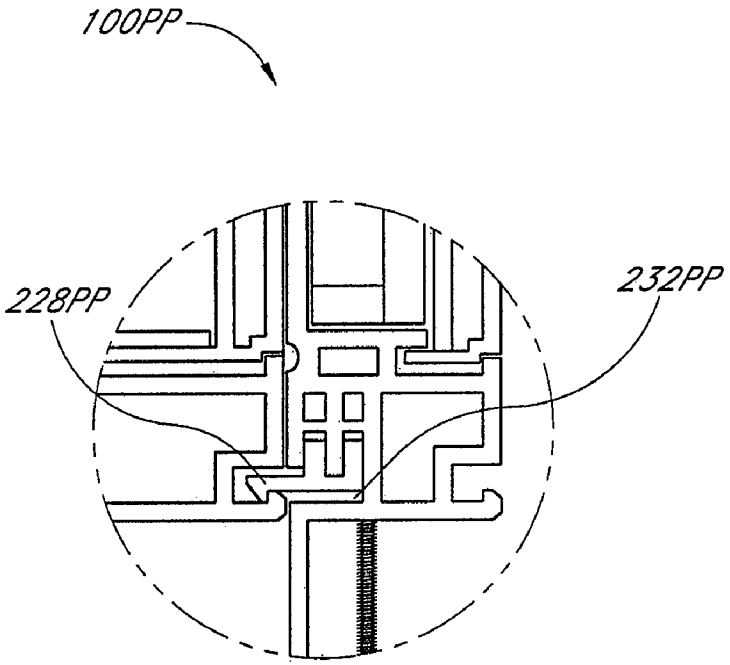
FIG. 46 is a is a schematic partial view and partial sectional view of a modification of the window assembly shown in FIG. 2.

FIG. 46 illustrates a modification of the assembly 100A illustrated in FIG. 2, identified generally by the reference numeral 100PP. Components of the window assembly 100PP that correspond to components of window assembly 100A have been given the same reference numeral, except that the letters "PP" have been added thereto.

In FIG. 46 the window assembly 100PP has a slide hook 228PP and a slide hook pocket 232PP. The slide hook 228PP has a plurality of tabs extending generally vertically to allow the slide hook 228PP to be adjusted within the slide hook pocket 232PP.

Figure 47:
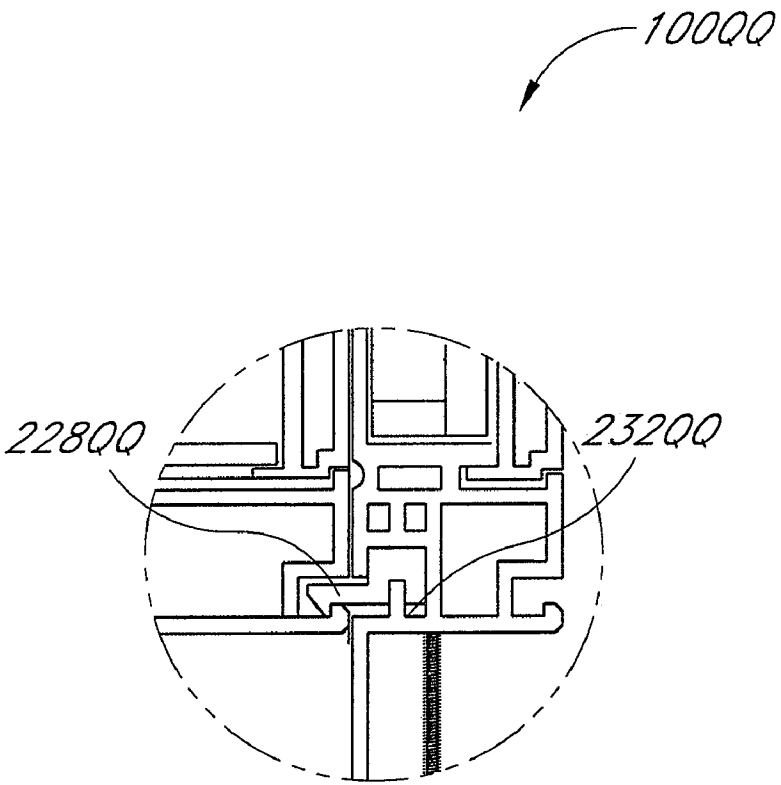
FIG. 47 is a schematic partial view and partial sectional view of a modification of the window assembly shown in FIG. 2.

FIG. 47 illustrates a modification of the assembly 100A illustrated in FIG. 2, identified generally by the reference numeral 100QQ. Components of the window assembly 100QQ that correspond to components of window assembly 100A have been given the same reference numeral, except that the letters "QQ" have been added thereto.

In FIG. 47 the window assembly 100QQ has a slide hook 228QQ and a slide hook pocket 232QQ. The slide hook 228QQ is configured to extend around a notch protruding from the slide hook pocket 232QQ.

Figure 48:
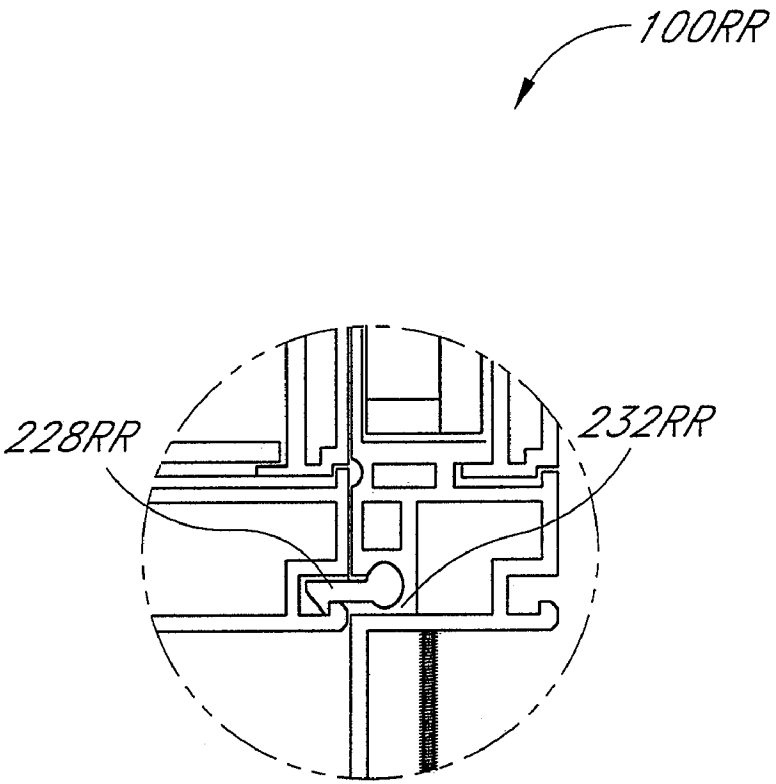
FIG. 48 is a schematic partial view and partial sectional view of a modification of the window assembly shown in FIG. 2.

FIG. 48 illustrates a modification of the assembly 100A illustrated in FIG. 2, identified generally by the reference numeral 100RR. Components of the window assembly 100RR that correspond to components of window assembly 100A have been given the same reference numeral, except that the letters "RR" have been added thereto.

In FIG. 48 the window assembly 100RR has a slide hook 228RR and a slide hook pocket 232RR. An anchor portion of the slide hook 228RR has a generally circular cross section that is configured to be fitted within a partially curved slide hook pocket 232RR.

Figure 49:
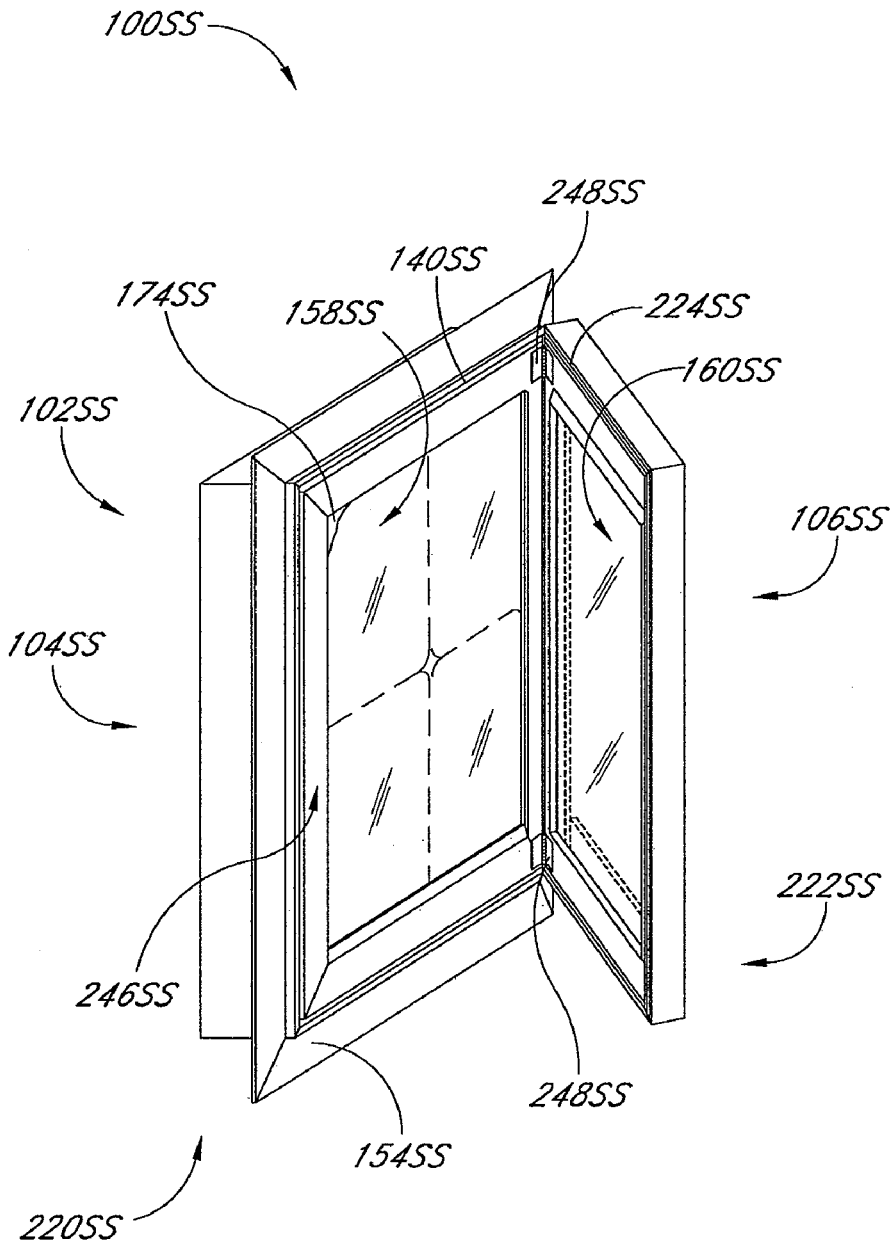
FIG. 49 is a schematic perspective view of a modification of the window assembly shown in FIG. 2.
Figure 50:
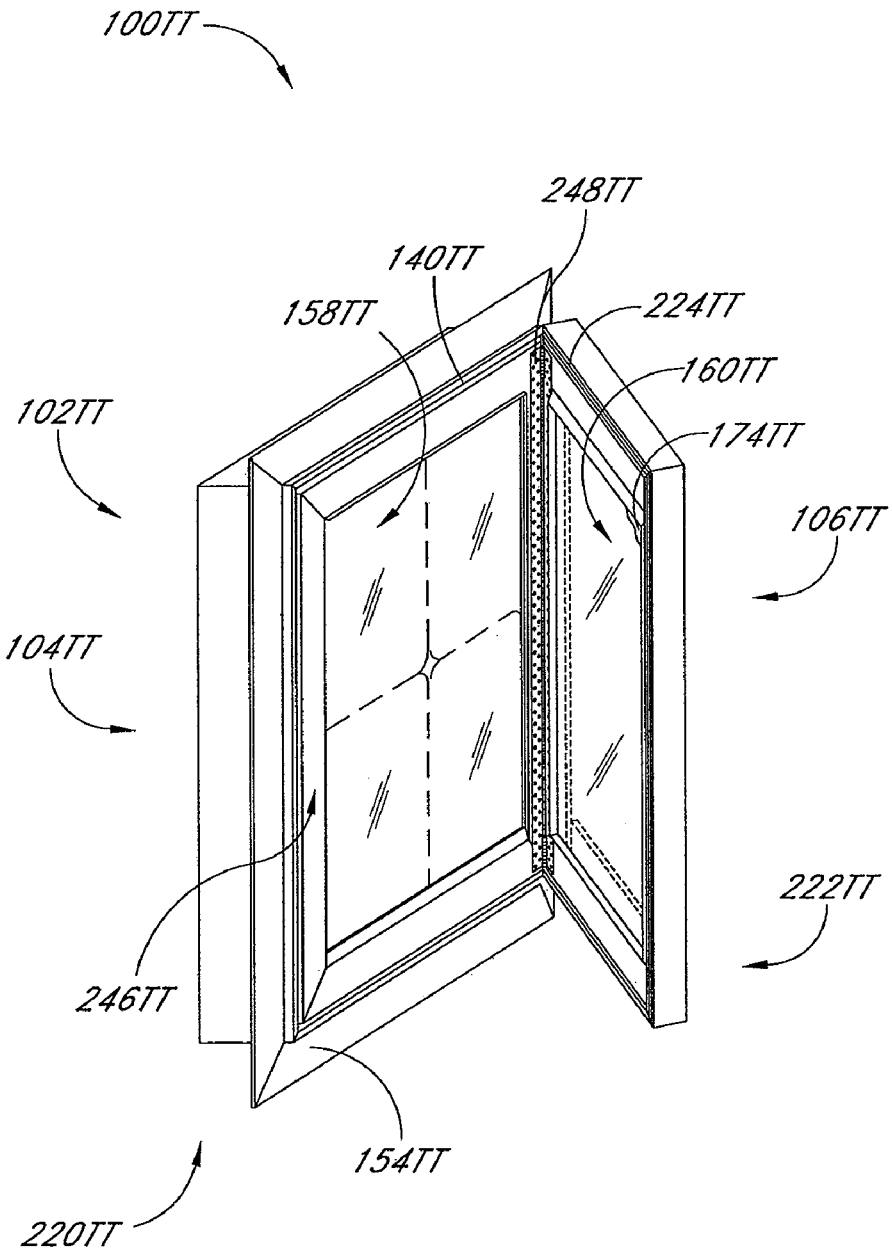
FIG. 50 is a schematic perspective view of a modification of the window assembly shown in FIG. 2.
Figure 51:
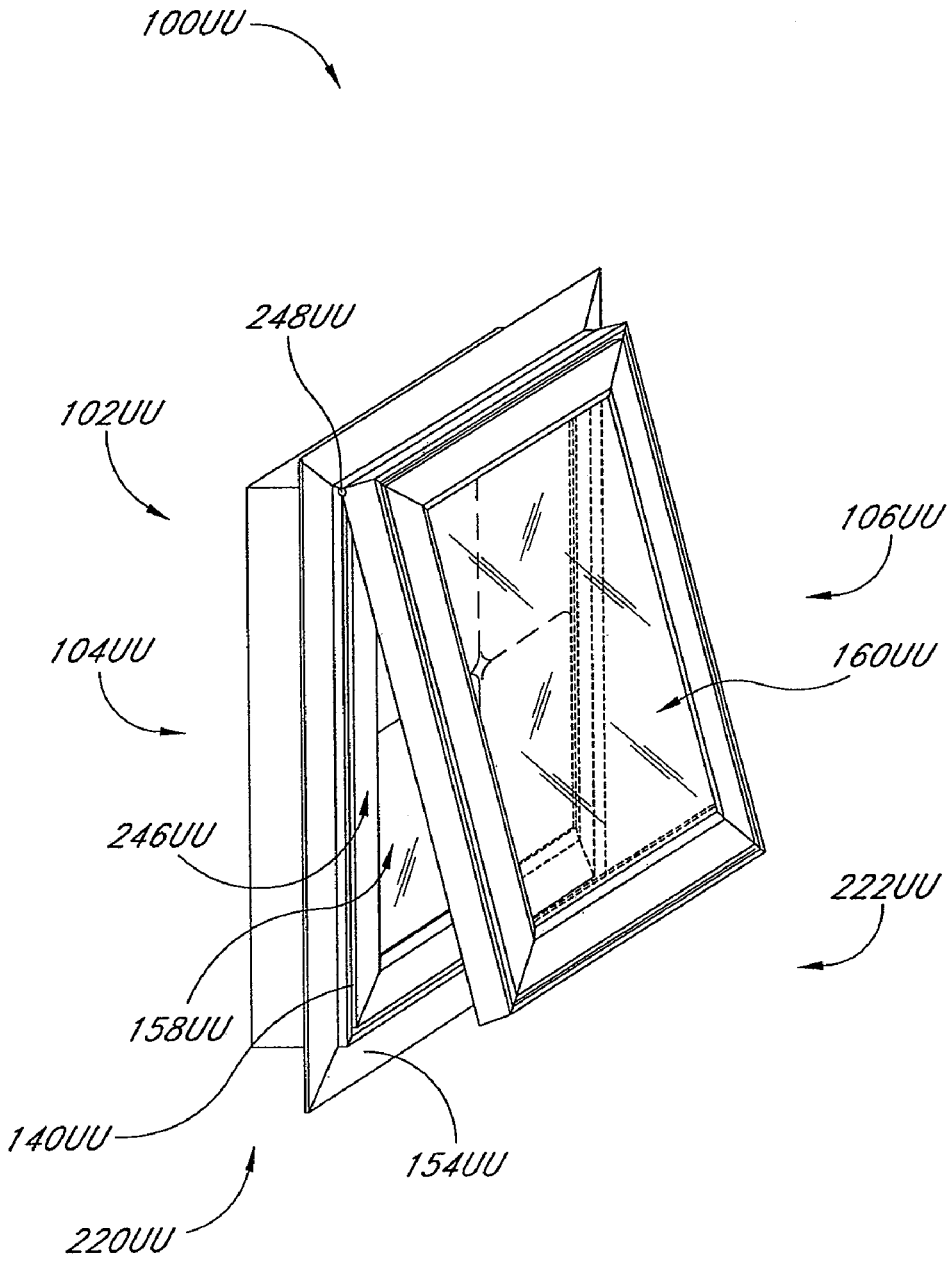
FIG. 51 is a schematic perspective view of a modification of the window assembly shown in FIG. 2.

FIGS. 49-51 illustrate various exemplary embodiments of a window assembly having a second window frame which can swing away from the first window frame to facilitate cleaning, maintenance, or repair. FIG. 49 illustrates a modification of the assembly 100A illustrated in FIG. 2, identified generally by the reference numeral 100SS. Components of the window assembly 100SS that correspond to components of window assembly 100A have been given the same reference numeral, except that the letters "SS" have been added thereto.

In FIG. 49 the window assembly 100SS is similar to those described previously. The window assembly 100SS preferably comprises components as described above with reference to FIGS. 31 and 32.

FIG. 49, however, illustrates side portions 246SS of the frame 102SS. The first window frame member 220SS can be coupled with the second window frame member 222SS with one or more hinges 248SS. In the illustrated embodiment, first and second hinges 248SS can be located at top and bottom portions of one side of the first and second window frame members 220SS, 222SS. Additionally, FIG. 49 illustrates a hurricane-proof film, or window-tint film 174SS, that can be applied to first or second window panel assemblies 104SS, 106SS.

FIG. 50 illustrates a modification of the assembly 100A illustrated in FIG. 2, identified generally by the reference numeral 100TT. Components of the window assembly 100TT that correspond to components of window assembly 100A have been given the same reference numeral, except that the letters "TT" have been added thereto.

In FIG. 50 the window assembly 100TT is similar to those described previously. The window assembly 100TT preferably comprises components as described above with reference to FIG. 49. FIG. 50, however, illustrates the first window frame member 220TT coupled with the second window frame member 222TT with a singe hinge 248TT extending from a top portion to a bottom portion along one side of the first and second window frame members 220TT, 222TT.

FIG. 51 illustrates a modification of the assembly 100A illustrated in FIG. 2, identified generally by the reference numeral 100UU. Components of the window assembly 100UU that correspond to components of window assembly 100A have been given the same reference numeral, except that the letters "UU" have been added thereto.

In FIG. 51 the window assembly 100UU is similar to those described previously. The window assembly 100UU preferably comprises components as described above with reference to FIG. 50. FIG. 51, however, illustrates the first window frame member 220UU coupled with the second window frame member 222UU with a singe hinge 248UU extending along top portions of the first and second window frame members 220UU, 222UU.

Although the present inventions have been described in terms of certain embodiments, other embodiments apparent to those of ordinary skill in the art also are within the scope of this invention. Thus, various changes and modifications can be made without departing from the spirit and scope of the invention. For instance, various components can be repositioned as desired. Moreover, not all of the features, aspects and advantages are necessarily required to practice the present invention. Accordingly, the scope of the present inventions is intended to be defined only by the claims that follow.

What is claimed is:

1. A window assembly comprising a window frame, a plurality of glass blocks forming a glass block window supported by the frame, and a transparent low-emissivity panel spaced from to the plurality of glass blocks and supported by the frame.

2. The window assembly according to claim 1, additionally comprising desiccant material disposed between the glass block window and the low-emissivity panel.

3. A window assembly comprising a window frame, a glass block window panel supported by the window frame and comprising a plurality of non-specular glass blocks joined together, and a low-emissivity window panel assembly spaced from to the glass block window panel on an outer side of the glass block window panel, the low-emissivity window panel assembly being supported by the window frame.

4. The window assembly according to claim 3 additionally comprising a desiccant material disposed between the glass block window panel and the low-emissivity window panel.

5. The window assembly according to claim 3 additionally comprising weather tight seals between the glass block window panel and the window frame and between the low-emissivity window panel assembly and the window frame.

6. The window assembly according to claim 3, wherein the window frame comprises a first frame assembly supporting the glass block window panel and an accessory pocket extending around a periphery of the first frame assembly, the window frame comprising a second frame assembly supporting the low-emissivity window panel assembly, the second frame assembly comprising a projection extending into the accessory pocket of the first frame assembly so as to support the second frame assembly relative to the first frame assembly.

7. The window assembly according to claim 6, additionally comprising at least one of mechanical and chemical fasteners extending through the projection and into the accessory pocket.

8. The window assembly according to claim 7, wherein the second frame assembly comprises a second accessory pocket opening towards an outer side of the second frame assembly.

9. The window assembly according to claim 3, wherein the frame is formed integrally with a wall.

* * * * *